US007506951B2

(12) United States Patent
Nishihara

(10) Patent No.: US 7,506,951 B2
(45) **Date of Patent: *Mar. 24, 2009**

(54) LIQUID EJECTION INSPECTING APPARATUS, PRINTING APPARATUS, AND LIQUID EJECTION SYSTEM FOR INSPECTING WHETHER OR NOT LIQUID IS EJECTED FROM A LIQUID EJECTION NOZZLE NORMALLY

(75) Inventor: Yuichi Nishihara, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 134 days.

This patent is subject to a terminal disclaimer.

(21) Appl. No.: 11/390,213

(22) Filed: Mar. 28, 2006

(65) Prior Publication Data

US 2006/0274105 A1 Dec. 7, 2006

(30) Foreign Application Priority Data

Mar. 28, 2005 (JP) ..... 2005-092309

(51) Int. Cl.
*B41J 29/393* (2006.01)

(52) U.S. Cl. ..... 347/19; 347/76

(58) Field of Classification Search ..... 347/19
See application file for complete search history.

(56) References Cited

U.S. PATENT DOCUMENTS 3,977,010 A 8/1976 Erickson et al.
2003/0020777 A1 1/2003 Su et al.
2003/0160838 A1* 8/2003 Su et al. ..... 347/19
2005/0212844 A1 9/2005 Nishihara

FOREIGN PATENT DOCUMENTS

| | | | |
|---|---|---|---|
| DE | 32 21 668 | A1 | 1/1983 |
| EP | 1 279 505 | A1 | 1/2003 |
| JP | 2000-233520 | A | 8/2000 |
| WO | WO 97/44193 | A | 11/1997 |

* cited by examiner

*Primary Examiner*—Luu Matthew
*Assistant Examiner*—Brian J Goldberg
(74) *Attorney, Agent, or Firm*—Sughrue Mion, PLLC

(57) ABSTRACT

A liquid ejection inspecting apparatus includes (A) a sensing section, (B) a detection circuit, (C) a determination section, and (D) a substrate. The sensing section is arranged in a state of non-contact with a liquid ejection nozzle for ejecting a liquid. The detection circuit is for detecting an induced current generated in the sensing section due to the liquid ejected from the liquid ejection nozzle and charged electrically. The determination section is for determining whether or not the liquid is ejected from the liquid ejection nozzle normally, based on the induced current detected by the detection circuit. The substrate is provided with the sensing section and a circuit component that constitutes the detection circuit. The sensing section is provided on one surface of the substrate. The circuit component that constitutes the detection circuit is provided on the other surface of the substrate.

13 Claims, 24 Drawing Sheets

LIQUID EJECTION INSPECTING APPARATUS, PRINTING APPARATUS, AND LIQUID EJECTION SYSTEM FOR INSPECTING WHETHER OR NOT LIQUID IS EJECTED FROM A LIQUID EJECTION NOZZLE NORMALLY

CROSS-REFERENCE TO RELATED APPLICATIONS

The present application claims priority upon Japanese Patent Application No. 2005-092309 filed on Mar. 28, 2005, which is herein incorporated by reference.

BACKGROUND

1. Technical Field

The invention relates to liquid ejection inspecting apparatuses, printing apparatuses, and liquid ejection systems.

2. Related Art

Among known printing apparatuses which eject ink to various types of media including paper, cloth, and films for printing are inkjet printers. Inkjet printers have a head which is capable of relative movement with respect to a medium and is provided with nozzle rows of respective colors such as cyan (C), magenta (M), yellow (Y), and black (K). For printing, the nozzles in each of the nozzle rows eject ink to form dots on the medium.

In such inkjet printers, nozzles can be clogged up due to adhering ink or the like, failing to eject ink normally. If ink is no longer ejected from the nozzles normally, problems may occur since dots cannot be formed on the medium properly and images cannot be printed finely.

Various types of methods have heretofore been proposed for inspecting whether or not ejection of ink is being performed normally. Among the inspecting methods proposed is one for detecting the ink ejected from the nozzles optically (see, for example, JP-A-2000-233520). In this inspecting method, whether or not ink is ejected from a nozzle is inspected by detecting, with a photodiode, whether or not a beam emitted from an LED is interrupted by the ink ejected from the nozzles.

Nevertheless, such an inspecting method requires a laser irradiation device of huge size for the sake of laser beam irradiation. This has caused another problem since it is extremely difficult to secure a space for installing the laser irradiation device inside a printer, with a significant increase in cost. Under such circumstances, an ejection inspecting apparatus having more simple, compact configuration, neither requiring much installation space nor causing a large increase in cost, has thus been desired strongly.

SUMMARY

The present invention has been achieved in view of the foregoing. An object is to inspect, more easily and efficiently, whether or not ejection of liquid is being performed normally (properly) regarding a nozzle for ejecting the liquid such as ink.

A main aspect of the invention is a liquid ejection inspecting apparatus including:

(A) a sensing section arranged in a state of non-contact with a liquid ejection nozzle for ejecting a liquid;

(B) a detection circuit for detecting an induced current generated in the sensing section due to the liquid ejected from the liquid ejection nozzle and charged electrically;

(C) a determination section for determining whether or not the liquid is ejected from the liquid ejection nozzle normally, based on the induced current detected by the detection circuit; and (D) a substrate provided with the sensing section and a circuit component that constitutes the detection circuit, the sensing section being provided on one surface of the substrate, the circuit component that constitutes the detection circuit being provided on the other surface of the substrate.

Other aspects of the present invention will become more apparent from the description of this specification and the accompanying drawings.

DESCRIPTION OF EXEMPLARY EMBODIMENTS

Figure 1:
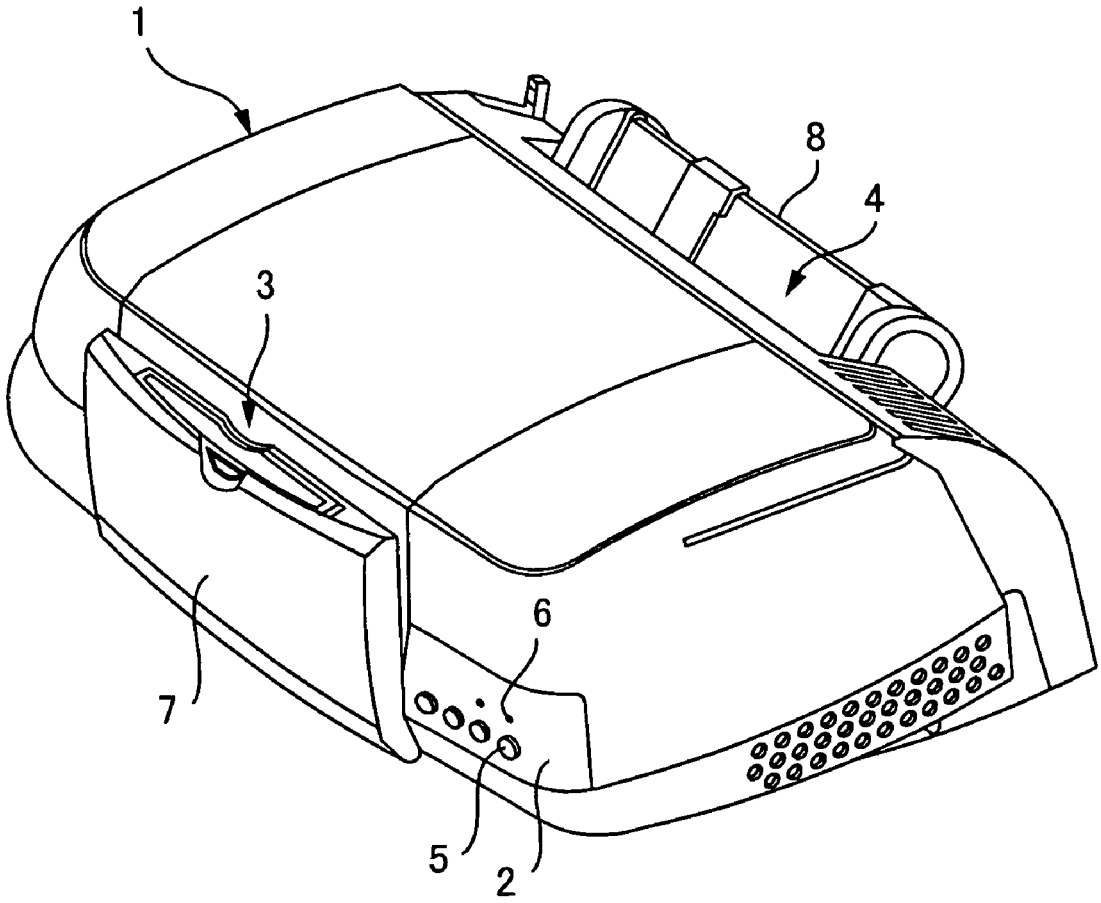
FIG. 1 is a perspective view of an embodiment of a liquid ejection apparatus (printing apparatus)

From the description of this specification and the accompanying drawings, at least the following will become apparent.

A liquid ejection inspecting apparatus includes:

(A) a sensing section arranged in a state of non-contact with a liquid ejection nozzle for ejecting a liquid;

(B) a detection circuit for detecting an induced current generated in the sensing section due to the liquid ejected from the liquid ejection nozzle and charged electrically;

(C) a determination section for determining whether or not the liquid is ejected from the liquid ejection nozzle normally, based on the induced current detected by the detection circuit; and (D) a substrate provided with the sensing section and a circuit component that constitutes the detection circuit, the sensing section being provided on one surface of the substrate, the circuit component that constitutes the detection circuit being provided on the other surface of the substrate.

According to this liquid ejection inspecting apparatus, the induced current occurring in the sensing section due to the electrically-charged liquid ejected from the liquid ejection nozzle is detected. This makes it possible to easily inspect whether the liquid is ejected from the liquid ejection nozzle normally or not. Moreover, the sensing section is formed on one surface of the substrate, and the circuit component constituting the detection circuit for detecting the induced current is formed on the other surface of the substrate. It is therefore possible to prevent the circuit component from being tainted with the liquid ejected from the liquid ejection nozzle.

In the foregoing liquid ejection inspecting apparatus, a ground section may be formed on the other side so as to correspond to a position where the sensing section is formed.

In this liquid ejection inspecting apparatus, a ground section may be provided on the other surface at a position corresponding to a position where the sensing section is provided. When such a ground section is provided, it is possible to prevent an induced current from occurring in the sensing section due to external noise.

In this liquid ejection inspecting apparatus, the sensing section may be made of a plate-like member. When the sensing section is thus made of a plate-like member, the sensing section can be provided with a sensing surface that is arranged along a direction of ejection of the liquid from the liquid ejection nozzle so that an induced current occurs easily in the sensing section.

In this liquid ejection inspecting apparatus, the sensing section may be formed as a pattern on the substrate. When the sensing section is thus formed as a pattern on a substrate, it is possible to easily arrange the sensing section with its sensing surface along the direction of ejection of the liquid from the liquid ejection nozzle.

In this liquid ejection inspecting apparatus, a voltage may be applied to the sensing section so that the liquid ejected from the liquid ejection nozzle is charged electrically. When the voltage is thus applied to the sensing section, the liquid ejected from the liquid ejection nozzle can be easily charged with electricity.

In this liquid ejection inspecting apparatus, a circuit component that constitutes a circuit for applying the voltage to the sensing section may be provided on the other surface of the substrate. When the circuit component is thus formed on the other side of the substrate, it is possible to prevent the circuit from being tainted with the liquid ejected from the liquid ejection nozzle.

The liquid ejection inspecting apparatus may further include an electrode section to which a voltage is applied so that the liquid ejected from the liquid ejection nozzle is charged electrically. When such an electrode section is provided, the liquid ejected from the liquid ejection nozzle can be easily charged with electricity.

In this liquid ejection inspecting apparatus, a circuit component that constitutes a circuit for applying the voltage to the electrode section may be provided on the other surface of the substrate. When the circuit component is thus formed on the other side of the substrate, it is possible to prevent the circuit from being tainted with the liquid ejected from the liquid ejection nozzle.

The liquid ejection inspecting apparatus may include a plurality of the liquid ejection nozzles, and the sensing section may be arranged in a direction in which the plurality of liquid ejection nozzles are arranged. Since the sensing section is thus arranged along the direction in which the liquid ejection nozzles are arranged, the plurality of liquid ejection nozzles can be kept stationary when making a determination as to whether ejection of liquid is being performed normally or not.

The liquid ejection inspecting apparatus may include a plurality of the liquid ejection nozzles, the liquid ejection nozzles may be capable of relative movement with respect to the sensing section, and the sensing section may be arranged in a direction intersecting with a direction in which the plurality of liquid ejection nozzles are arranged. In a configuration where there are a plurality of liquid ejection nozzles, these nozzles are formed so as to be capable of relative movement with respect to the sensing section, and the sensing section is arranged in a direction intersecting with the direction in which the plurality of liquid ejection nozzles are arranged, it becomes possible to move the liquid ejection nozzles relatively with respect to the sensing section while making determinations as to whether or not the liquid is normally ejected from the plurality of liquid ejection nozzles.

Another liquid ejection inspecting apparatus includes:

(A) a sensing section arranged in a state of non-contact with a liquid ejection nozzle for ejecting a liquid;

(B) a detection circuit for detecting an induced current generated in the sensing section due to the liquid ejected from the liquid ejection nozzle and charged electrically;

(C) a determination section for determining whether or not the liquid is ejected from the liquid ejection nozzle normally, based on the induced current detected by the detection circuit; and (D) a substrate provided with the sensing section and a circuit component that constitutes the detection circuit, the sensing section being provided on one surface of the substrate, the circuit component that constitutes the detection circuit being provided on the other surface of the substrate, (E) wherein a ground section is provided on the other surface at a position corresponding to a position where the sensing section is provided, (F) wherein the sensing section is formed as a pattern on the substrate, (G) wherein a voltage is applied to the sensing section so that the liquid ejected from the liquid ejection nozzle is charged electrically, (H) wherein a circuit for applying the voltage to the sensing section is provided on the other surface of the substrate, (I) wherein the liquid ejection inspecting apparatus includes a plurality of the liquid ejection nozzles, and (J) wherein the sensing section is arranged in a direction in which the plurality of liquid ejection nozzles are arranged.

Further, a printing apparatus includes:

(A) a nozzle for ejecting an ink;

(B) a sensing section arranged in a state of non-contact with the nozzle;

(C) a detection circuit for detecting an induced current generated in the sensing section due to the ink ejected from the nozzle and charged electrically;

(D) a determination section for determining whether or not the ink is ejected from the nozzle normally, based on the induced current detected by the detection circuit; and (E) a substrate provided with the sensing section and a circuit component that constitutes the detection circuit, the sensing section being provided on one surface of the substrate, the circuit component that constitutes the detection circuit being provided on the other surface of the substrate.

Further, a liquid ejection system includes:

a computer; and a liquid ejection apparatus that is connectable to the computer and that includes:

a liquid ejection nozzle for ejecting a liquid;

a sensing section arranged in a state of non-contact with the liquid ejection nozzle;

a detection circuit for detecting an induced current generated in the sensing section due to the liquid ejected from the liquid ejection nozzle and charged electrically;

a determination section for determining whether or not the liquid is ejected from the liquid ejection nozzle normally, based on the induced current detected by the detection circuit; and a substrate provided with the sensing section and a circuit component that constitutes the detection circuit, the sensing section being provided on one surface of the substrate, the circuit component that constitutes the detection circuit being provided on the other surface of the substrate.

Overview of Liquid Ejection Apparatus (Printing Apparatus)

Figure 2:
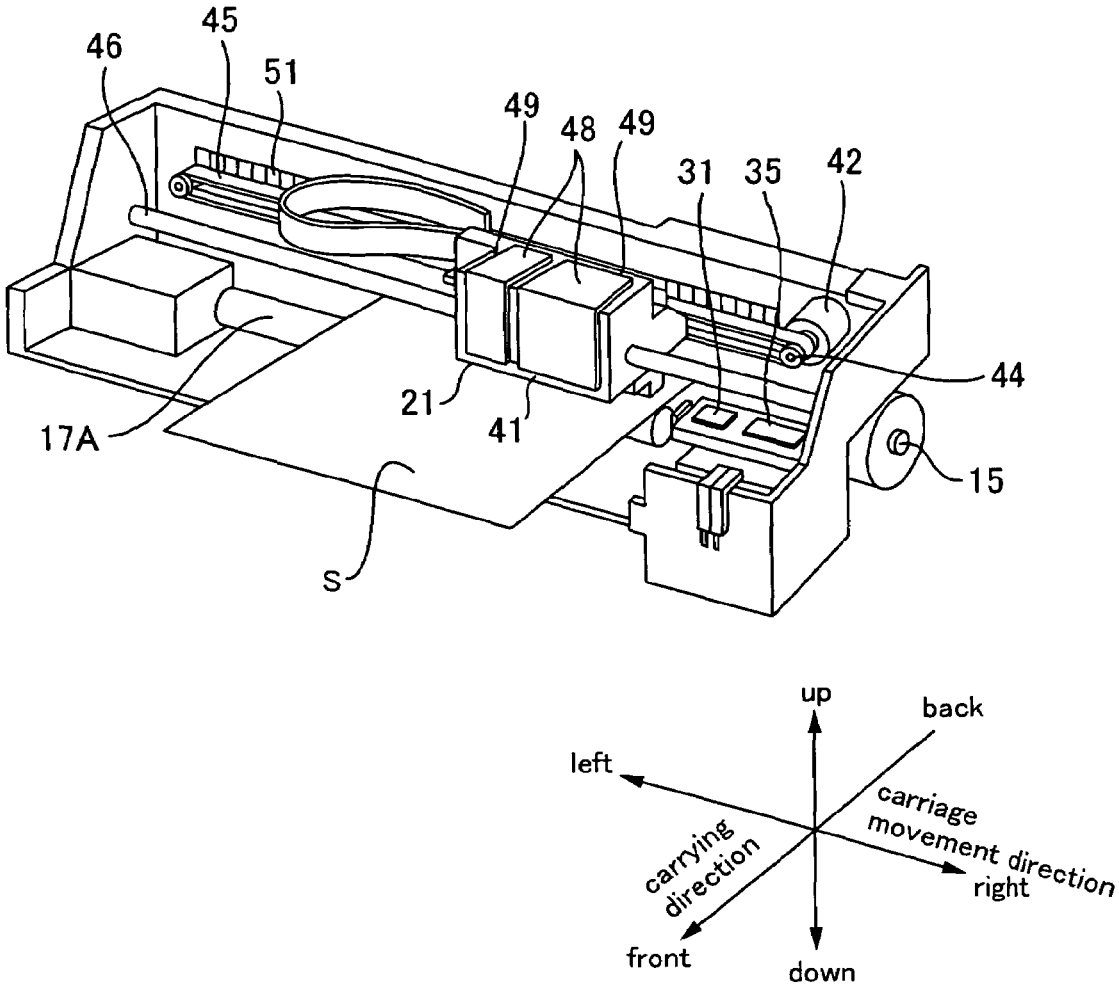
FIG. 2 is a perspective view for explaining the internal configuration of the liquid ejection apparatus (printing apparatus)
Figure 3:
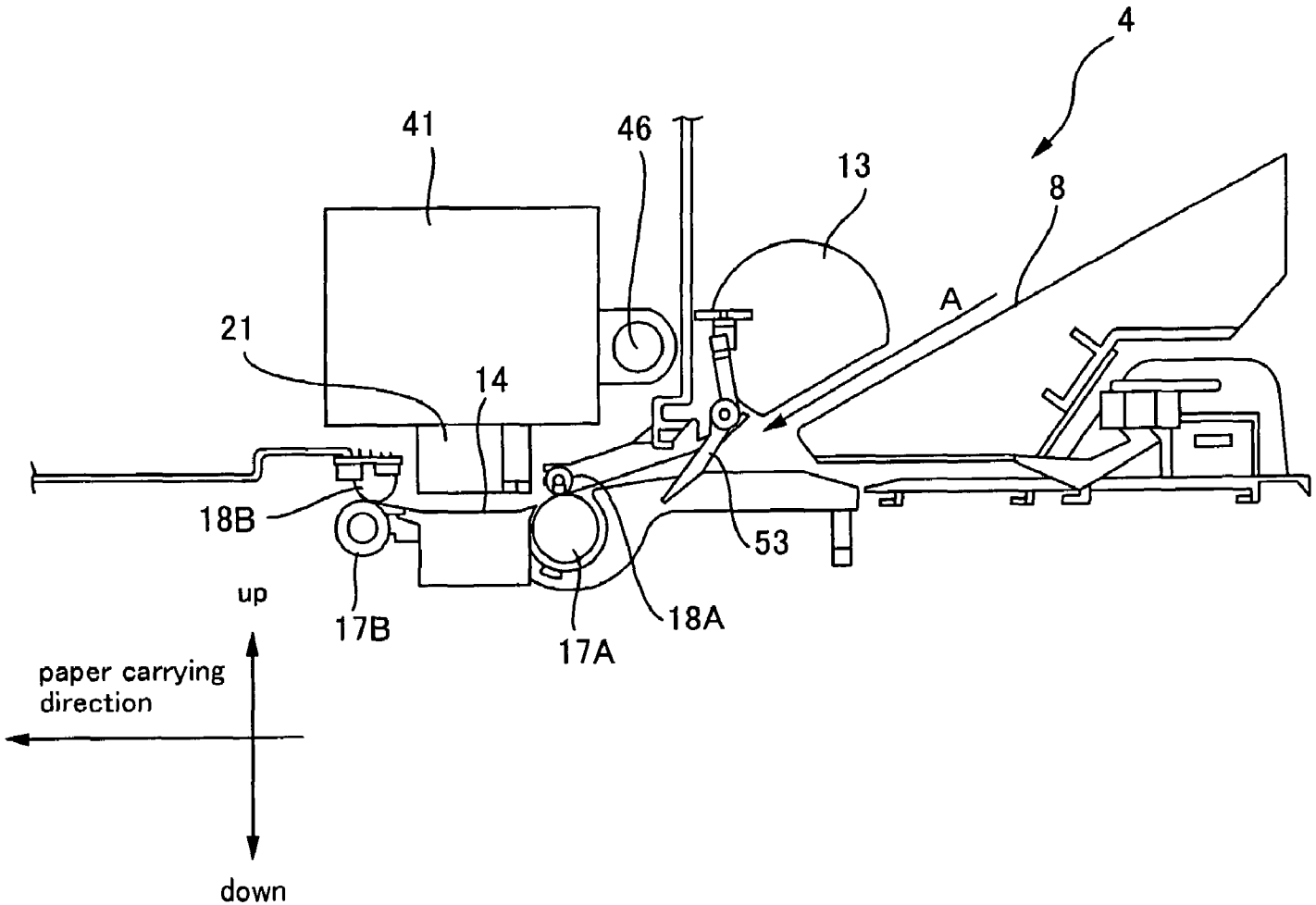
FIG. 3 is a sectional view showing a carrying section of the liquid ejection apparatus (printing apparatus)
Figure 4:
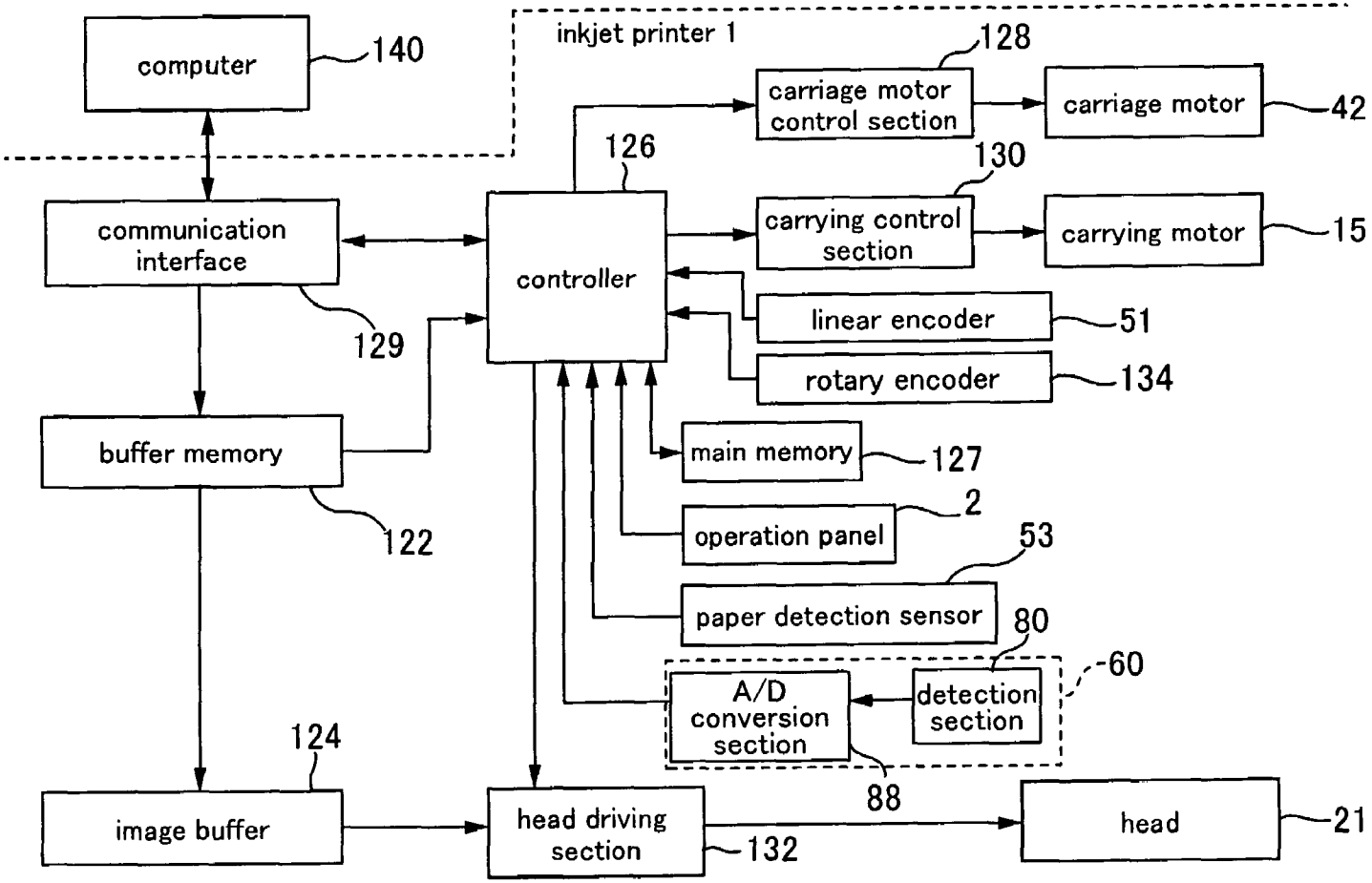
FIG. 4 is a block diagram showing the system configuration of the liquid ejection apparatus (printing apparatus)

Now, taking an inkjet printer 1 as an example, description is will be given of an embodiment of the liquid ejection apparatus and the printing apparatus according to the present invention. FIGS. 1 to 4 show the inkjet printer 1. FIG. 1 shows the appearance of the inkjet printer 1. FIG. 2 shows the internal configuration of the inkjet printer 1. FIG. 3 shows the configuration of a carrying section of the inkjet printer 1. FIG. 4 shows the system configuration of the inkjet printer 1.

As shown in FIG. 1, this inkjet printer 1 has a structure by which a medium supplied from the back side, such as a print sheet, is discharged from the front side. An operation panel 2 and a paper discharge section 3 are formed on the front side. A paper supply section 4 is formed on the back side. The operation panel 2 is provided with various operation buttons 5 and display lamps 6. The paper discharge section 3 is provided with a paper-discharge tray 7 which covers a discharge opening when not in use. The paper supply section 4 is provided with a supply tray 8 which holds such media as cut sheets.

As shown in FIG. 2, a carriage 41 is arranged inside the inkjet printer 1. This carriage 41 is arranged so as to be capable of relative movement in right and left directions. A carriage motor 42, a pulley 44, a timing belt 45, and a guide rail 46 are arranged in the vicinity of the carriage 41. The carriage motor 42 is made of a DC motor or the like, and is the driving source for moving the carriage 41 relatively with respect to the inkjet printer 1 in the right and left directions (hereinafter, also referred to as carriage movement direction). The timing belt 45 is connected to the carriage motor 42 via the pulley 44, and a portion thereof is connected to the carriage 41. When rotationally driven by the carriage motor 42, the timing belt 45 moves the carriage 41 relatively with respect to the inkjet printer 1 in the carriage movement direction (right and left directions). The guide rail 46 guides the carriage 41 along the carriage movement direction (right and left directions).

In addition, a linear encoder 51, a carrying roller 17A, and a carrying motor 15 are formed in the vicinity of the carriage 41. The linear encoder 51 detects the position of the carriage 41. The carrying roller 17A is intended to carry a medium S in a direction intersecting with the movement direction of the carriage 41 (the back-to-front direction in the diagram; hereinafter, also referred to as carrying direction). The carrying motor 15 drives this carrying roller 17A rotationally.

Meanwhile, the carriage 41 is provided with ink cartridges 48 which contain various inks, and a head 21 for printing onto the medium S. For example, the ink cartridges 48 contain inks of yellow (Y), magenta (M), cyan (C), and black (K) colors, and are detachably attached to a cartridge mount 49 which is formed on the carriage 41. In the present embodiment, the head 21 ejects the inks onto the medium S for printing. For this purpose, the head 21 has a large number of nozzles for ejecting the inks.

In addition, this inkjet printer 1 includes such devices as a pump device 31 and a capping device 35. The pump device 31 sucks out the inks from the nozzles of the head 21 in order to resolve nozzle clogging. The capping device 35 caps the nozzles of the head 21 when not in printing (such as when in standby) for the purpose of preventing the head 21 from nozzle clogging.

Next, the carrying section of this inkjet printer 1 will be described. As shown in FIG. 3, this carrying section includes a supply roller 13, a paper detection sensor 53, the carrying roller 17A, a discharge roller 17B, a platen 14, and free rollers 18A and 18B.

The medium S to be printed is loaded on the supply tray 8. The medium S loaded on the supply tray 8 is carried along the direction of the arrow A in the diagram by the supply roller 13 having a generally D-shaped cross section, and thereby supplied into the inkjet printer 1. The medium S fed into the inkjet printer 1 comes into contact with the paper detection sensor 53. This paper detection sensor 53 is interposed between the supply roller 13 and the carrying roller 17A, and detects the medium S that is supplied by the supply roller 13.

The medium S detected by the paper detection sensor 53 is sequentially carried by the carrying roller 17A to the platen 14 where printing is performed. The free roller 18A is arranged in a position opposed to the carrying roller 17A. This free roller 18A and the carrying roller 17A sandwich the medium S, thereby carrying the medium S smoothly.

The medium S fed to the platen 14 is sequentially printed with inks that are ejected from the head 21. The platen 14 is opposed to the head 21, and supports from below the medium S to be printed.

The printed medium S is sequentially discharged from the printer by the discharge roller 17B. The discharge roller 17B is driven in synchronization with the carrying motor 15. This discharge roller 17B and the opposed free roller 18B sandwich the medium S and discharge the medium S from the printer.

<System Configuration>

Next, description will be given of the system configuration of this inkjet printer 1. As shown in FIG. 4, this inkjet printer 1 has a buffer memory 122, an image buffer 124, a controller 126, a main memory 127, a communication interface 129, a carriage motor control section 128, a carrying control section 130, and a head driving section 132.

The communication interface 129 is intended for this inkjet printer 1 to exchange data with an external computer 140 such as a personal computer. The communication interface 129 can be connected to the external computer 140 through wired or wireless communications, and receives various types of data transmitted from the computer 140 such as print data.

The buffer memory 122 temporarily stores various types of data received by the communication interface 129 such as the print data. The image buffer 124 sequentially stores the print data stored in the buffer memory 122. The print data stored in the image buffer 124 is sequentially transmitted to the head driving section 132. The main memory 127 is made of a ROM, a RAM, an EEPROM, or the like. The main memory 127 stores various programs, setting data, and the like for controlling this inkjet printer 1.

The controller 126 reads control programs, setting data, and the like from the main memory 127, and controls the entire inkjet printer 1 in accordance with the control programs and setting data. The controller 126 also receives detection signals from various types of sensors including a rotary encoder 134, the linear encoder 51, and the paper detection sensor 53.

When various types of data sent from the external computer 140, such as print data, is received by the communication interface 129 and stored into the buffer memory 122, the controller 126 reads necessary information included in the stored data from the buffer memory 122. Based on the read information, the controller 126 controls the carriage motor control section 128, the carrying control section 130, the head driving section 132, and other components individually in accordance with the control programs and by referring to the outputs of the linear encoder 51 and the rotary encoder 134.

The carriage motor control section 128 exercises a drive control on the direction of rotation, the number of times of rotations, the torque, and other factors of the carriage motor 42 under instructions from the controller 126. The carrying control section 130 exercises a drive control on such components as the carrying motor 15 which rotationally drives the carrying roller 17A, under instructions from the controller 126.

The head driving section 132 exercises a drive control on the nozzles of each color formed in the head 21, under instructions from the controller 126 and based on the print data stored in the image buffer 124.

Aside from these, the inkjet printer 1 according to the present embodiment also includes a detection section 80 and an A/D conversion section 88 as components of a liquid ejection inspecting apparatus 60. This liquid ejection inspecting apparatus 60 is one for inspecting whether or not the inks are normally ejected from the nozzles formed in the head 21. This liquid ejection inspecting apparatus 60 will be detailed later.

<Head>

Figure 5:
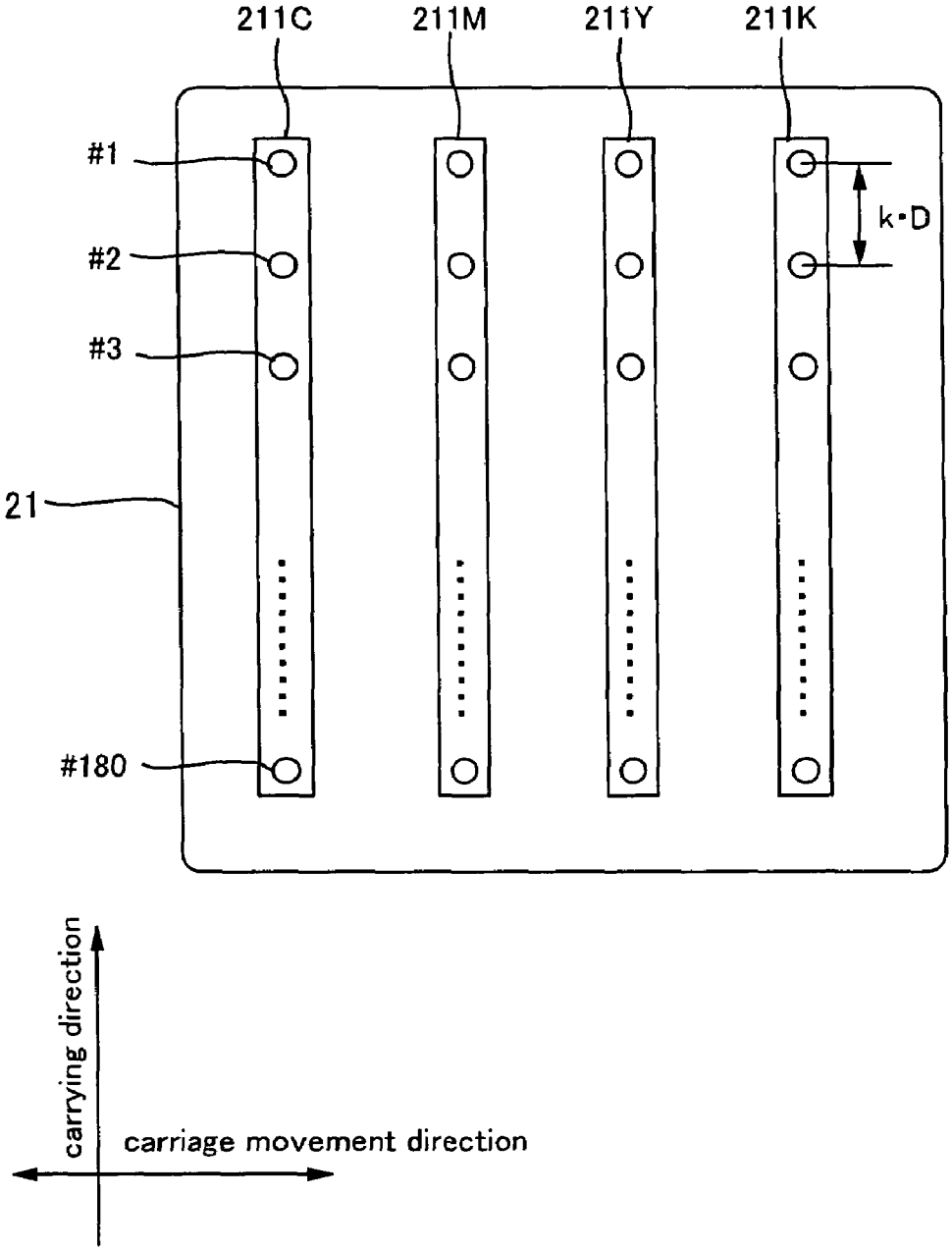
FIG. 5 is an explanatory diagram showing the arrangement of nozzles in a head.

FIG. 5 is a diagram showing the arrangement of the ink nozzles formed in the bottom of the head 21. As shown in the diagram, nozzle rows of yellow (Y), magenta (M), cyan (C), and black (K) colors, each consisting of a plurality of nozzles #1 to #180, are formed in the bottom of the head 21. More specifically, the head 21 has a cyan nozzle row 211C, a magenta nozzle row 211M, a yellow nozzle row 211Y, and a black nozzle row 211K.

The nozzles #1 to #180 in each of the nozzle rows 211C, 211M, 211Y, and 211K are spaced from each other and arranged in a row on a straight line in a predetermined direction (here, the carrying direction of the medium S). The pitch between the nozzles #1 to #180 (nozzle pitch) is set at "k·D." Here, "D" is the minimum dot pitch in the carrying direction (in other words, the pitch of dots to be formed on the medium S at a maximum resolution). Further, "k" is an integer no smaller than 1. For example, given a nozzle pitch of 120 dpi (1/120 inch) and a dot pitch of 360 dpi (1/360 inch) in the carrying direction, k=3. The nozzle rows 211C, 211M, 211Y, and 211K are arranged in parallel to one another at predetermined intervals therebetween in the movement direction (scanning direction) of the head 21. The nozzles #1 to #180 are provided with piezoelectric devices (not shown) as respective driving devices for ejecting ink drops.

The nozzles #1 to #180 in each of the nozzle rows 211C, 211M, 211Y, and 211K are arranged on a straight line in the predetermined direction. In the present embodiment, when the head 21 is installed properly, the nozzles #1 to #180 in each of the nozzle rows 211C, 211M, 211Y, and 211K are arranged along the carrying direction of the medium S. The nozzle rows 211C, 211M, 211Y, and 211K are spaced from each other in the movement direction (scanning direction) of the head 21 and arranged in parallel to one another. The nozzles #1 to #180 are provided with piezoelectric devices (not shown) as respective driving devices for ejecting ink drops.

When voltages are applied to electrodes provided on both sides of the respective piezoelectric devices for a predetermined period of time, the piezoelectric devices expand in accordance with the duration of voltage application and deform sidewalls of ink channels. As a result, the volumes of the ink channels change in accordance with the expansion and contraction of the piezoelectric devices, and as much inks as the amounts of expansion/contraction are ejected from the respective nozzles #1 to #180 of the nozzle rows 211C, 211M, 211Y, and 211K in the form of ink drops.

<Driving Circuit>

Figure 6:
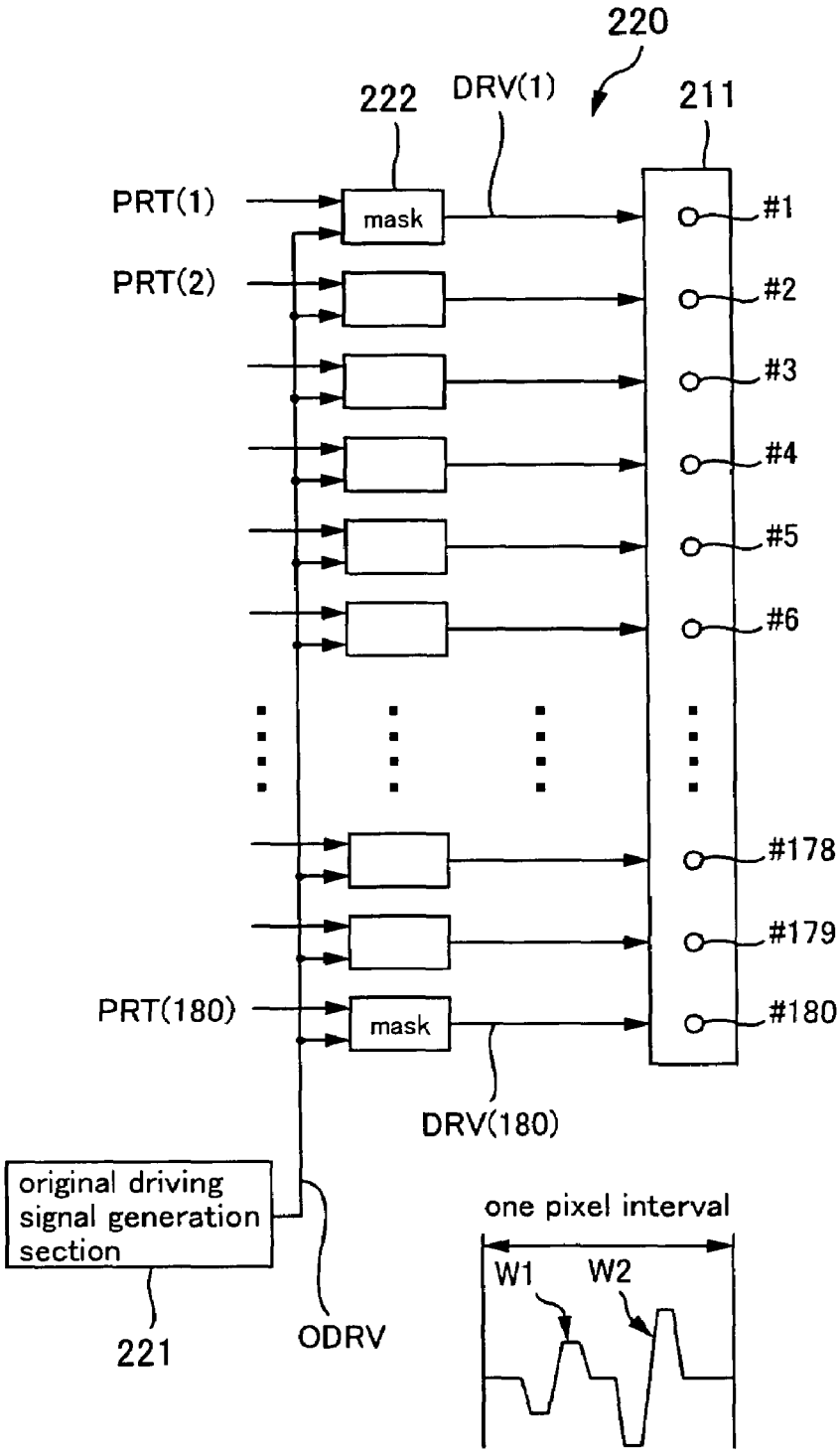
FIG. 6 is a diagram for explaining an example of a driving circuit of the head.

FIG. 6 shows a driving circuit 220 of the nozzles #1 to #180. As shown in the diagram, this driving circuit 220 has an original driving signal generation section 221 and a plurality of mask circuits 222. The original driving signal generation section 221 generates an original driving signal ODRV which is used in common by the nozzles #1 to #180. As shown to the bottom in the diagram, this original driving signal ODRV has two pulses, or a first pulse W1 and a second pulse W2, in a main scan period for a single pixel (i.e., the time for the carriage 41 to travel across a single pixel interval). The original driving signal ODRV generated by the original driving signal generation section 221 is output to each of the mask circuits 222.

The mask circuits 222 are provided so as to correspond to the plurality of piezoelectric devices for driving the nozzles #1 to #180 of the head 21, respectively. The mask circuits 222 each receive the original driving signal ODRV from the original driving signal generation section 221, as well as a print signal PRT (i). This print signal PRT(i) is pixel data corresponding to each pixel. This signal is binary, having two bits of information per single pixel. The bits correspond to the first pulse W1 and the second pulse W2, respectively. The mask circuits 222 are gates for blocking or passing the original driving signal ODRV in accordance with the levels of the printing signals PRT(i). That is, if the print signal PRT(i) is "0" in level, the pulse of the original driving signal ODRV is blocked. If the print signal PRT(i) is "1" in level, on the other hand, the corresponding pulse of the original driving signal ODRV is passed through as an actual driving signal DRV and output to the piezoelectric device of the corresponding nozzle #1 to #180. Based on the actual driving signals DRV from the mask signals 222, the piezoelectric devices of the nozzles #1 to #180 are driven for ink ejection.

<Signal Waveforms>

Figure 7:
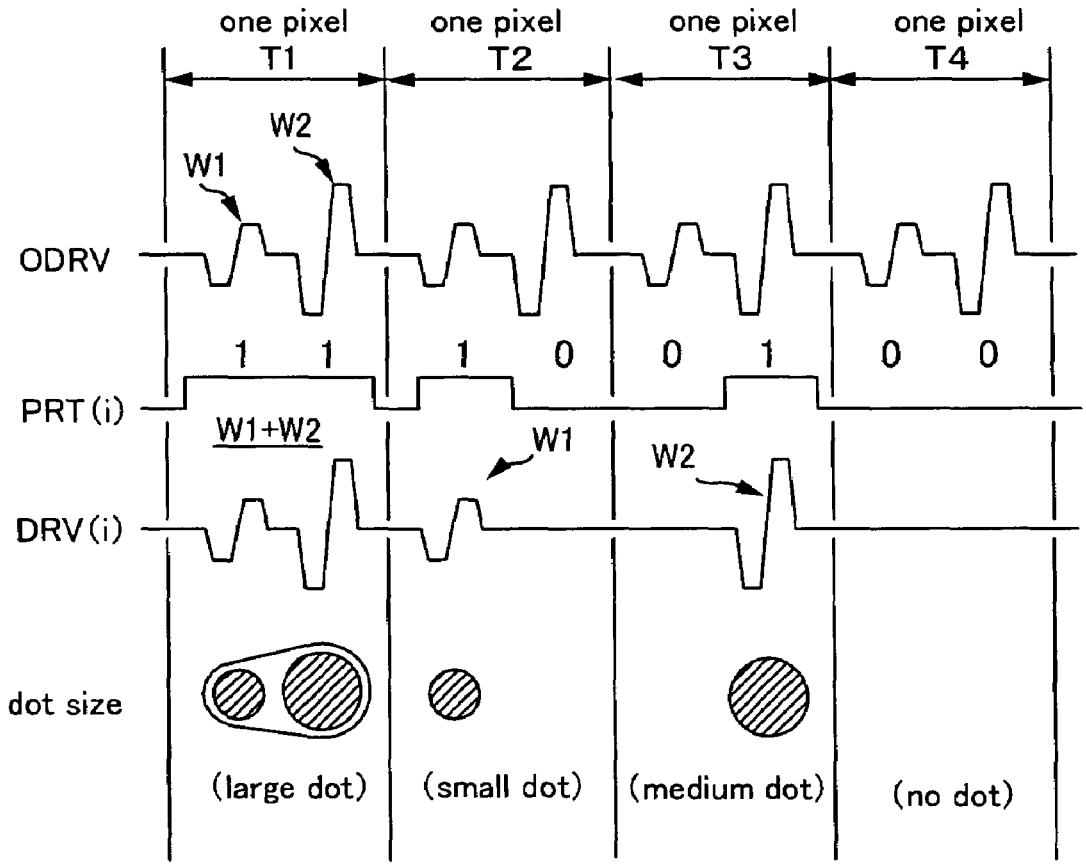
FIG. 7 is a timing chart of signals.

FIG. 7 is a timing chart of the original driving signal ODRV, the print signal PRT(i), and the actual driving signal DRV(i), which show the operation of the original driving signal generation section 221. As shown in the chart, the original driving signal ODRV generates the first pulse W1 and the second pulse W2 in succession in each of pixel intervals T1, T2, T3, and T4. Incidentally, a pixel interval is equivalent to the interval of movement of the carriage 41 for a single pixel.

When the print signals PRT(i) correspond to two-bit pixel data "10," the first pulse W1 alone is output in the first half of a single pixel interval. As a result, small ink drops are ejected from the nozzles #1 to #180, whereby small-sized dots (small dots) are formed on the medium S. When the print signals PRT(i) correspond to two-bit pixel data "01," the second pulse W2 alone is output in the last half of a single pixel interval. As a result, medium-sized ink drops are ejected from the nozzles #1 to #180, whereby medium-sized dots (medium dots) are formed on the medium S. When the print signals PRT(i) correspond to two-bit pixel data "11," both the first pulse W1 and the second pulse W2 are output in a single pixel interval. As a result, large-sized ink drops are ejected from the nozzles #1 to #180, whereby large-sized dots (large dots) are formed on the medium S. As described above, the actual driving signals DRV(i) in a single pixel interval are shaped into three types of respective different waveforms depending on the three different values of the print signals PRT(i). Based on these signals, the head 21 can form dots in three sizes and adjust the amounts of inks ejected within each pixel interval. Moreover, as in the pixel interval T4, when the print signals PRT(i) correspond to two-bit pixel data "00," no ink drop is ejected from the nozzles #1 to #180 at all. It follows that no dot is formed on the medium S.

In the inkjet printer 1 according to the present embodiment, the foregoing driving circuit 220 of the nozzle #1 to #180 is provided for each of the nozzle rows 211C, 211M, 211Y, and 211K, i.e., each of the colors of yellow (Y), magenta (M), cyan (C), black (K) separately. The piezoelectric devices are thus driven in units of the nozzles #1 to #180 in each of the nozzle rows 211C, 211M, 211Y, and 211K.

Print Operation

Figure 8:
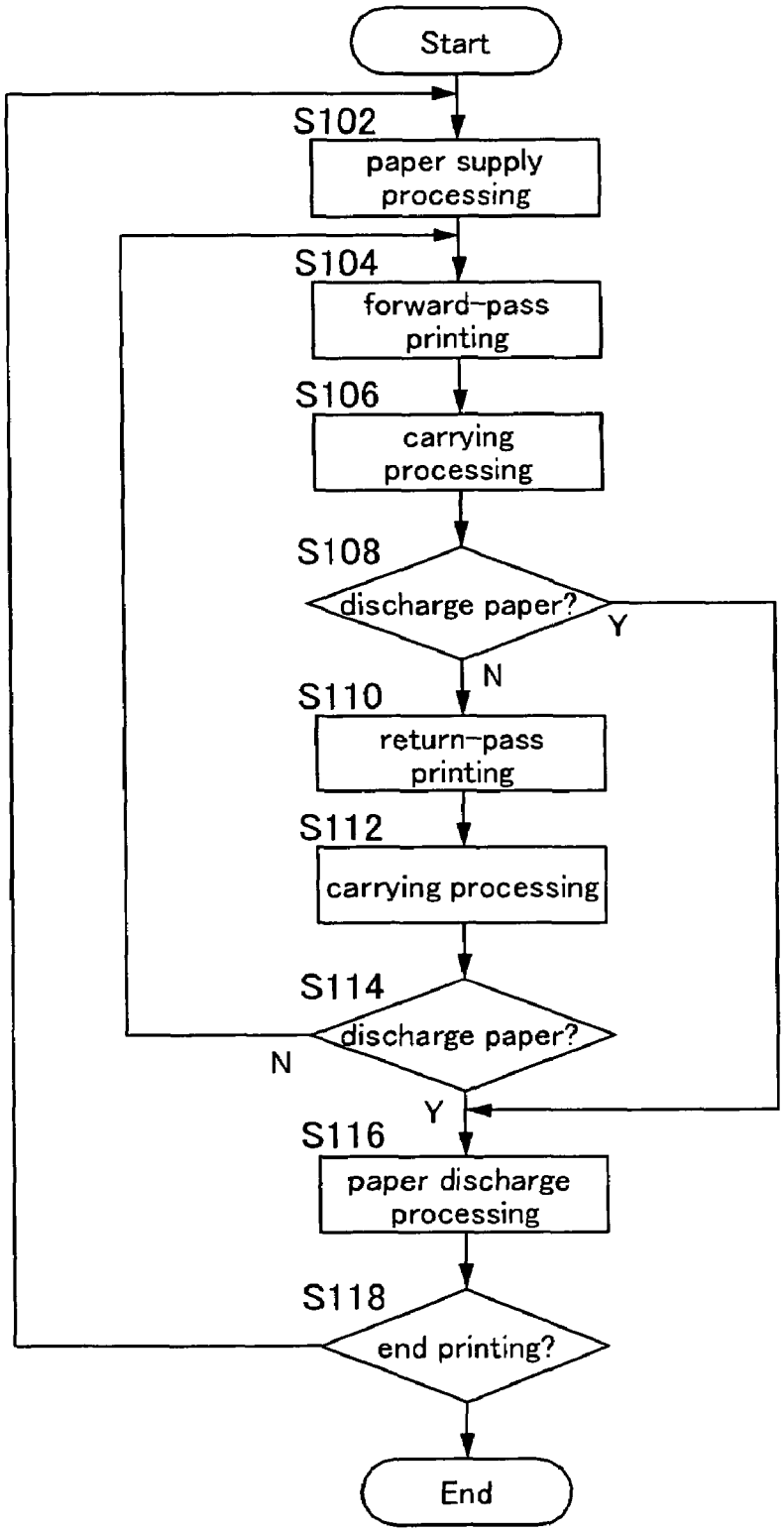
FIG. 8 is a flowchart for explaining an example of print processing.

Next, description will be given of the print operation of the inkjet printer 1 described above. The following description will deal with an example of "bidirectional printing." FIG. 8 is a flowchart showing an example of the processing steps for the print operation of the inkjet printer 1. To execute the individual processes to be described below, the controller 126 reads a program from the main memory 127 and controls such components as the carriage motor control section 128, the carrying control section 130, and the head driving section 132 individually in accordance with the program.

When the controller 126 receives print data from the computer 140, it initially performs paper supply processing (S102) in order to execute printing based on that print data. In the paper supply processing, a medium S to be printed is supplied into the inkjet printer 1 and carried up to a starting position of printing (also referred to as cue position). The controller 126 rotates the supply roller 13 to feed the medium S to be printed to the carrying roller 17A. The controller 126 rotates the carrying roller 17A so that the medium S fed from the supply roller 13 is positioned to the starting position of printing (near the upper section of the platen 14).

Next, the controller 126 drives the carriage motor 42 via the carriage motor control section 128, thereby performing print processing of printing onto the medium S by moving the carriage 41 relatively with respect to the medium S. Here, forward-pass printing is first performed in which the carriage 41 is moved in one direction along the guide rail 46 while inks are ejected from the head 21 (S104). The controller 126 drives the carriage motor 42 to move the carriage 41, and drives the head 21 to eject inks based on the print data. The inks ejected from the head 21 reach the medium S to form dots.

After this printing, the controller 126 executes carrying processing for carrying the medium S by a predetermined amount (S106). Here, the controller 126 drives the carrying motor 15 via the carrying control section 130 to rotate the carrying roller 17A, whereby the medium S is carried in the carrying direction by the predetermined amount with respect to the head 21. This carrying processing makes it possible for the head 21 to print onto an area different from the area just printed.

After this carrying processing, the controller 126 makes a determination on whether or not to discharge the paper (S108). If there is no more data to be printed onto the medium S in process, the controller 126 executes paper discharge processing (S116). On the other hand, if there still is data to be printed onto the medium S in process, the controller 126 executes return-pass printing (S110), not the paper discharge processing. In this return-pass printing, the carriage 41 is moved in the direction opposite from that in the foregoing forward-pass printing along the guide rail 46 to perform printing. Again, the controller 126 drives the carriage motor 42 via the carriage motor control section 128 to rotate in the opposite direction from the previous direction to move the carriage 41, and drives the head 21 to eject inks for printing based on the print data.

After the return-pass printing, the controller 126 executes carrying processing (S112), and then makes a determination on paper discharge (S114). If there still is data to be printed onto the medium S in process, the controller 126 returns to step S104 to execute the forward-pass printing again (S104) without the paper discharge processing. On the other hand, if there is no data to be printed onto the medium S in process, the controller 126 performs the paper discharge processing (S116).

After the paper discharge processing, the controller 126 makes a print end determination as to whether or not to end the printing (S118). Here, the controller 126 checks whether there is a next medium S to be printed, based on the print data from the computer 140. If there is another medium S to be printed, the controller 126 returns to step S102 to execute the paper supply processing again, and starts printing. On the other hand, if there is no other medium S to be printed, the print processing is ended.

Liquid Ejection Inspecting Apparatus

Now, description will be given of an embodiment of the liquid ejection inspecting apparatus according to the present invention. The following description will deal with a case where the liquid ejection inspecting apparatus according to the present invention is mounted on the inkjet printer 1 (liquid ejection apparatus, or printing apparatus) described above.

<Inspection Principle>

Figure 9:
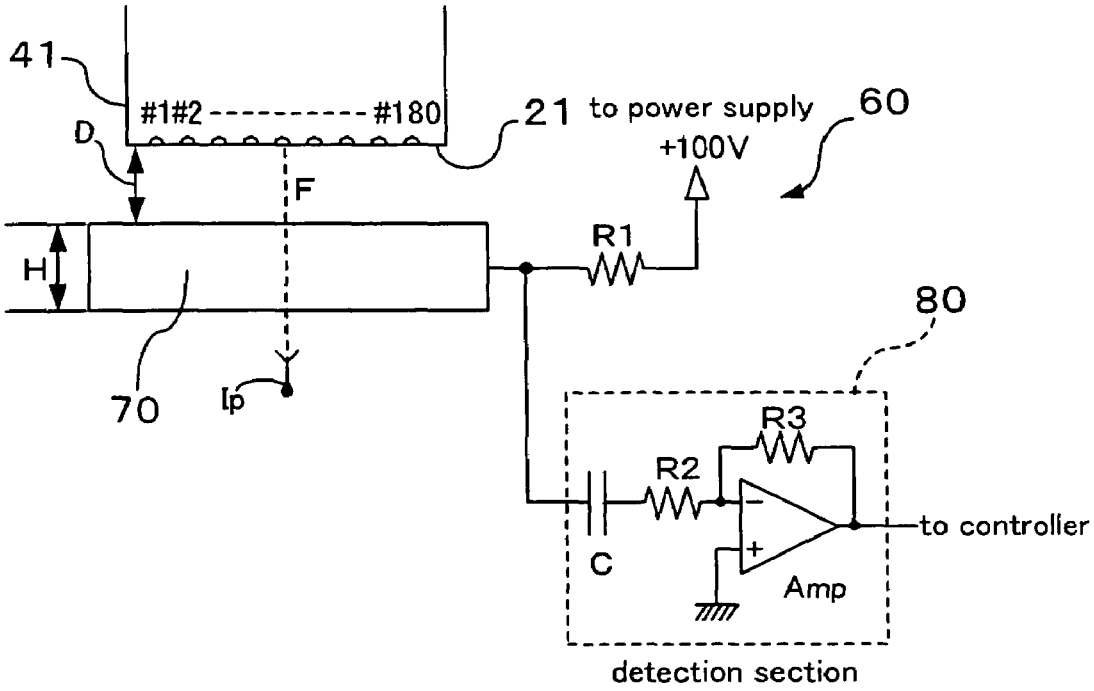
FIG. 9 is an explanatory diagram for explaining an embodiment of a liquid ejection inspecting apparatus.
Figure 10:
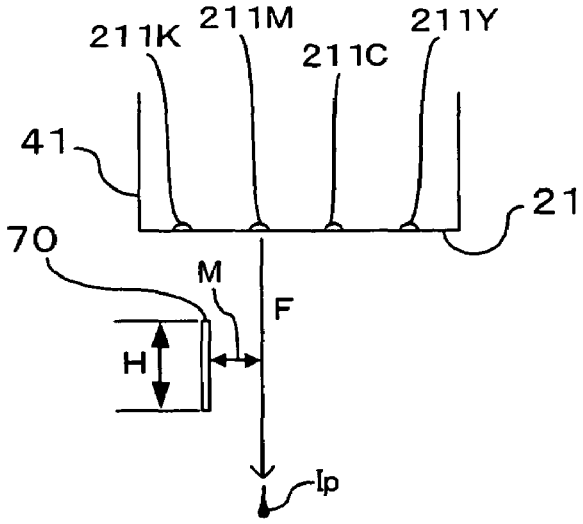
FIG. 10 is an explanatory diagram for explaining the embodiment of the liquid ejection inspecting apparatus.

FIGS. 9 and 10 schematically show the liquid ejection inspecting apparatus 60 which is mounted on the inkjet printer 1 of the present embodiment, and the inspecting method thereof. FIG. 9 is an explanatory diagram for explaining the configuration of the liquid ejection inspecting apparatus 60. FIG. 10 is an explanatory diagram for explaining the inspection principle of the liquid ejection inspecting apparatus 60.

As shown in FIG. 9, this liquid ejection inspecting apparatus 60 has a sensing section 70 which is located in a position where it can face the head 21, and a detection section 80 which is connected to this sensing section 70. The sensing section 70 is made of a conductive material such as metal. Here, as shown in FIG. 10, the sensing section 70 is formed as a strip of plate-like member having a predetermined thickness and a width of H. As shown in FIG. 9, the sensing section 70 is arranged along the lateral direction in parallel with the head 21. As shown in FIG. 10, the sensing section 70 is also arranged with its side surface in parallel with the paths of ejection of ink drops Ip from the nozzles #1 to #180 which are formed in the head 21. In other words, the sensing section 70 has a surface that is arranged in the direction in which the ink drops Ip are ejected from the nozzles #1 to #180. The sensing section 70 is given a width H of around 2 to 3 mm, for example.

The sensing section 70 is located so that it can oppose the head 21 in a state of non-contact at a distance D from the head 21 when the carriage 41 is moved. The distance D between the head 21 and the sensing section 70 is set to 1 mm, for example.

The sensing section 70 is also connected with a power supply (not shown) through a protective resistor R1. As a result, a high voltage of, e.g., around +100 V is applied from this power supply to the sensing section 70.

Meanwhile, the detection section 80 is configured to detect the current generated in the sensing section 70. In the present embodiment, this detection section 80 is made of a detection circuit including a capacitor C, an input resistor R2, a feedback resistor R3, and an operational amplifier Amp. The capacitor C functions to input current variations occurring in the sensing section 70 to the operational amplifier Amp through the input resistor R2 as an electric signal. The operational amplifier Amp functions as an amplifier circuit for amplifying and outputting the signal input through the capacitor C. The analog output signal from the operational amplifier Amp is converted into a digital signal by the A/D conversion section 88 (see FIG. 4), and transmitted to the controller 126 in an appropriate form such as digital data.

To perform an ejection inspection actually, the nozzles #1 to #180 of the head 21 make respective operations for ejecting ink to or near to the sensing section 70 individually. FIG. 10 shows how ink is ejected from one of the nozzles of the head 21 near to the sensing section 70. Here, the nozzles #1 to #180 of the head 21 shall each eject an ink drop Ip only once, i.e., a single drop each.

The sensing section 70 is undergoing an extremely high voltage of, e.g., around 100 V due to the supply voltage from the power supply. An extremely strong electric field is thus formed between the head 21 and the sensing section 70. When the nozzles #1 to #180 eject ink drops Ip in this situation, the ejected ink drops Ip are charged with electricity.

The electrically-charged ink drops Ip ejected from the nozzles #1 to #180 pass by the sensing section 70. When an electrically-charged ink drop Ip passes by the sensing section 70, an induced current is generated in the sensing section 70. The electrically-charged ink drop Ip produces the induced current in the sensing section 70 when approaching the sensing section 70. Note that this induced current is thought to occur because of electrostatic induction ascribable to the approach of the electrically-charged ink drop Ip. In the present embodiment, as shown in FIG. 9, the sensing section 70 is formed as a strip of plate-like member having a width of H, and is arranged with its side surface in parallel with the paths of ejection of ink drops Ip from the nozzles #1 to #180. This configuration makes it possible to produce larger amounts of induced currents in the sensing section 70 by the approach of electrically-charged ink drops Ip.

The amounts of the induced currents to occur in the sensing section 70 correspond to the distances M between this sensing section 70 and the flying paths F of the ink drops Ip. That is, the closer to the sensing section 70 the flying path F of an ink drop Ip is, the larger the intensity of the induced current generated in the sensing section 70 is. The farther from the sensing section 70 the flying path F of an ink drop Ip is, the smaller the intensity of the induced current occurring in the sensing section 70 is.

When the sensing section 70 thus undergoes an induced current corresponding to the distance between the sensing section 70 and the flying path F of an ink drop Ip, the current input to the detection section 80 shows a variation. This current variation is input to the operational amplifier Amp through the input resistor R2 as an electric signal. The signal input to the operational amplifier Amp is then amplified, and output as a detection signal to the controller 126 and the like. Consequently, the induced current occurring in the sensing section 70 is detected by the detection section 80. This analog detection signal is converted into digital data or the like through the A/D conversion section 88 (see FIG. 4), and output to the controller 126.

If none of the nozzles #1 to #180 ejects ink drops Ip, on the other hand, there will not occur a sufficient amount of induced current in the sensing section 70 since electrically-charged ink drops Ip do not pass by the sensing section 70. The detection section 80 thus will not output a sufficient amount of detection signal.

The controller 126 acquires the amounts of induced currents occurring in the sensing section 70 from the signal levels of detection signals output from the detection section 80. Based on the amounts of the induced currents, the controller 126 can determine whether ink drops Ip are ejected from the nozzles #1 to #180. Moreover, based on the amounts of the induced currents occurring in the sensing section 70, the controller 126 can determine whether or not the distances M between the flying paths F of the ink drops Ip and the sensing section 70 fall within predetermined distances. Accordingly, the controller 126 can determine whether the directions of ejection of the ink drops Ip from the nozzles #1 to #180 are normal or not.

That is, if the amounts of the induced currents occurring in the sensing section 70 fall within a predetermined range, the controller 126 determines that the distances M between the flying paths F of the ink drops Ip and the sensing section 70 are within the predetermined distances. The controller 126 then determines that the directions of ejection of the ink drops Ip from the nozzles #1 to #180 are normal. If the amounts of the induced currents occurring in the sensing section 70 fall outside the predetermined range, the controller 126 determines that the distances M between the flying paths F of the ink drops Ip and the sensing section 70 are out of the predetermined distances. The controller 126 then determines that the directions of ejection of the ink drops Ip from the nozzles #1 to #180 are not normal. Incidentally, in the present embodiment, this controller 126 corresponds to the "determination section" for determining whether ink is ejected normally or not.

In this way, the controller 126 determines whether ejection of ink drops Ip from the nozzles #1 to #180 is being normally performed, by making such determinations as whether ink drops Ip are ejected or not and whether the directions of ejection of the ink drops Ip are normal or not. In addition, the controller 126 can acquire such factors as the timing of occurrence of induced currents in the sensing section 70, and determine whether the speeds of ejection of ink drops Ip from the nozzles #1 to #180 are normal.

Incidentally, for the purpose of ejection inspection, the ink drops Ip to be ejected from the nozzles #1 to #180 preferably have as large a size as possible. More specifically, in the inkjet printer 1 of the present embodiment, it is preferable to set the size near equal to that of ink drops Ip that are ejected to form dots of the largest size, i.e., large dots (pixel data "11") on the medium S. The reason for this is that the larger size the ink drops Ip ejected from the nozzles #1 to #180 have, the larger amounts of electricity the ink drops Ip ejected from the nozzles #1 to #180 are charged with. When the amounts of charge of the ink drops Ip are thus increased, it becomes easier to cause induced currents in the sensing section 70. As a result, the detection section 80 can detect the induced currents of the sensing section 70 more easily.

It is understood that the size of the ink drops Ip to be ejected during an ejection inspection is not necessarily set to that for forming the dots of the largest size (such as large dots). Ink drops Ip having an especially large size may be ejected only during an ejection inspection. Also, ink drops Ip having a small size may instead be ejected.

The nozzles #1 to #180 need not necessarily eject ink drops Ip near to the sensing section 70, but so that the ink drops Ip come into contact with the sensing section 70. Even in this case, the ink drops Ip can cause induced currents in the sensing section 70 when approaching the sensing section 70. It is therefore possible to inspect whether or not ejection of the ink drops Ip is being performed normally.

The ink drops Ip to be ejected from the respective nozzles #1 to #180 are not necessarily limited to one in number. That is, the nozzles #1 to #180 each may eject ink drops Ip a plurality of times successively. Ejecting ink drops Ip a plurality of times successively can increase the numbers of ink drops Ip that pass by the sensing section 70, thereby facilitating the occurrence of induced currents in the sensing section 70. In consequence, the detection section 80 can detect the induced currents more easily.

Actual Detection Waveforms

Figure 11:
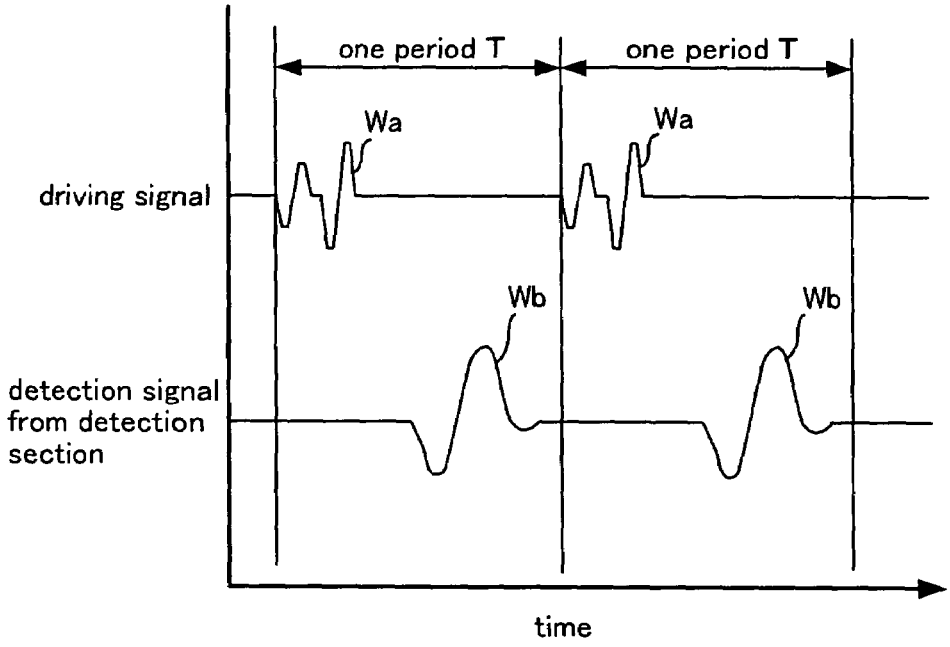
FIG. 11 is an explanatory diagram showing a driving signal for ejecting ink and a detection signal from a detection section.

FIG. 11 shows the waveform of the driving signal that is output to the piezoelectric devices formed in the respective nozzles #1 to #180 in order to eject ink for ejection inspection, and the waveform of the detection signal from the detection section 80. In the chart, the upper waveform is that of the driving signal, and the lower waveform is that of the detection signal from the detection section 80. When an ejection inspection is performed on a nozzle, the piezoelectric device formed in the nozzle to be inspected receives, as its driving signal, the driving pulse Wa for ejecting an ink droplet once, i.e., for ejecting a single ink drop, as shown in the chart.

When the nozzle to be inspected ejects ink normally in response to this driving signal, the ink drop Ip ejected from the nozzle to be inspected causes an induced current in the sensing section 70. This induced current is detected by the detection section 80, and the detection section 80 outputs, as a detection signal, a pulse Wb having a waveform peaking in both directions as shown in the chart. It takes some time from when the nozzle to be inspected ejects the ink drop Ip until the induced current is generated, and there also is a little time lag for the generated induced current to be detected and output by the detection section 80 after the occurrence. It follows that the pulse of the detection signal output from the detection section 80 rises with a delay as compared to the driving pulse of the driving signal.

On the other hand, if the nozzles #1 to #180 do not eject ink normally, no induced current occurs in the sensing section 70. For this reason, the pulse Wb having such a waveform as shown in the chart will not appear clearly in the detection signal of the detection section 80.

Incidentally, the ejection inspection may be performed on a plurality of nozzles, such as a single row of nozzles or 180 nozzles #1 to #180 successively together. Here, as shown in the chart, the driving signal repeats the driving pulse for ejecting an ink drop Ip once (i.e., a single ink drop) to be inspected at predetermined periods T. Corresponding to this driving signal, in the detection signal from the detection section 80 are formed pulses Wb at predetermined periods T as shown in the chart if the nozzles #1 to #180 eject ink normally. Here, the predetermined period T may be set freely with reference to the time to elapse between the output of the driving pulses Wa to the nozzles #1 to #180 to be inspected and the appearance of the pulses Wb in the detection signal from the detection section 80. The nozzles #1 to #180 can be inspected individually by checking the detection signal from the detection section 80 at every period T.

Determination on the Presence or Absence of Ejection

Figure 12:
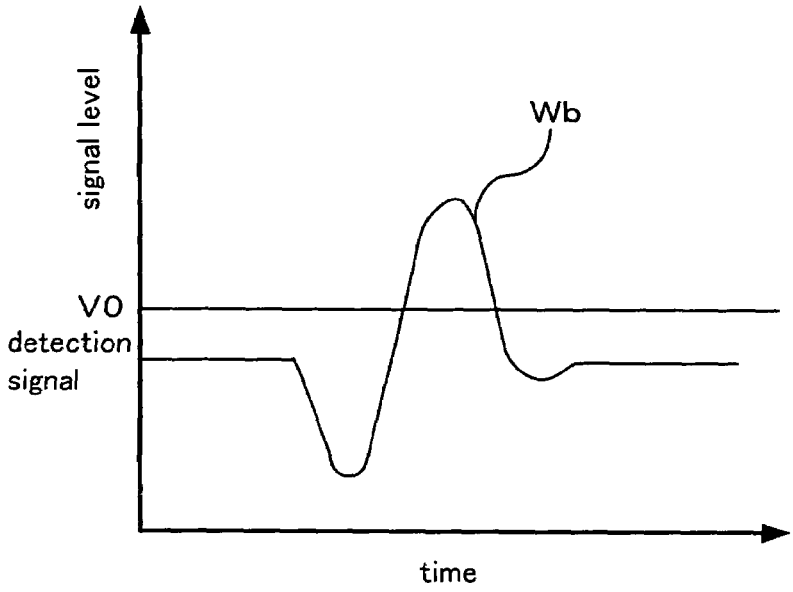
FIG. 12 is an explanatory diagram for explaining an example of the method for determining if ink is ejected.

FIG. 12 shows an example of a method by which the controller 126 determines whether or not ink drops Ip are ejected from the nozzles #1 to #180. Here, the controller 126 compares the intensity of the induced current occurring in the sensing section 70, i.e., the signal level of the detection signal output from the detection section 80 with a predetermined reference value V0 to check whether or not the signal level of the detection signal output from the detection section 80 reaches the predetermined reference value V0. Comparisons between the signal level of the detection signal output from the detection section 80 and the predetermined reference value V0 are made by the controller 126 successively.

When ink drops Ip are ejected from the nozzles #1 to #180 to cause induced currents in the sensing section 70, pulses Wb occur in the detection signal from the detection section 80 as shown in the chart. Here, the detection signal rises in signal level and reaches the predetermined reference value V0. If the signal level of the detection signal thus reaches the predetermined reference value V0, the controller 126 determines that sufficient amounts of induced currents occur in the sensing section 70, and determines that ink is ejected from those nozzles.

On the other hand, if the nozzles #1 to #180 do not eject ink drops Ip, no induced current occurs in the sensing section 70. Therefore, the detection signal of the detection section 80 shows no pulse Wb. As a result, the signal level of the detection signal from the detection section 80 will not rise to reach the predetermined reference value V0. Consequently, the controller 126 determines that there is no induced current of sufficient amount occurring in the sensing section 70, and determines that no ink drop Ip is ejected from those nozzles.

In this way, the controller 126 inspects whether or not ink drops are ejected from the respective nozzles #1 to #180, based on the detection signal output from the detection section 80.

Here, the predetermined reference value V0 is set to an appropriate value so as not to cause errors during ejection inspection. It should be noted that the information on this predetermined reference value V0 is stored as data in an appropriate storage section such as a memory including the main memory 127. When comparing the intensity of the detection signal and the predetermined reference value V0, the controller 126 acquires the information on the predetermined reference value V0 from the appropriate storage section such as the main memory 127.

Determination on the Direction of Ejection

Next, an example of a method for inspecting whether the directions of ejection of ink drops Ip from the nozzles #1 to #180 are normal or not will be described. Whether the directions of ejection of ink drops Ip are normal or not is also determined by the controller 126. The controller 126 makes the determinations based on the detection signal output from the detection section 80.

Figure 13:
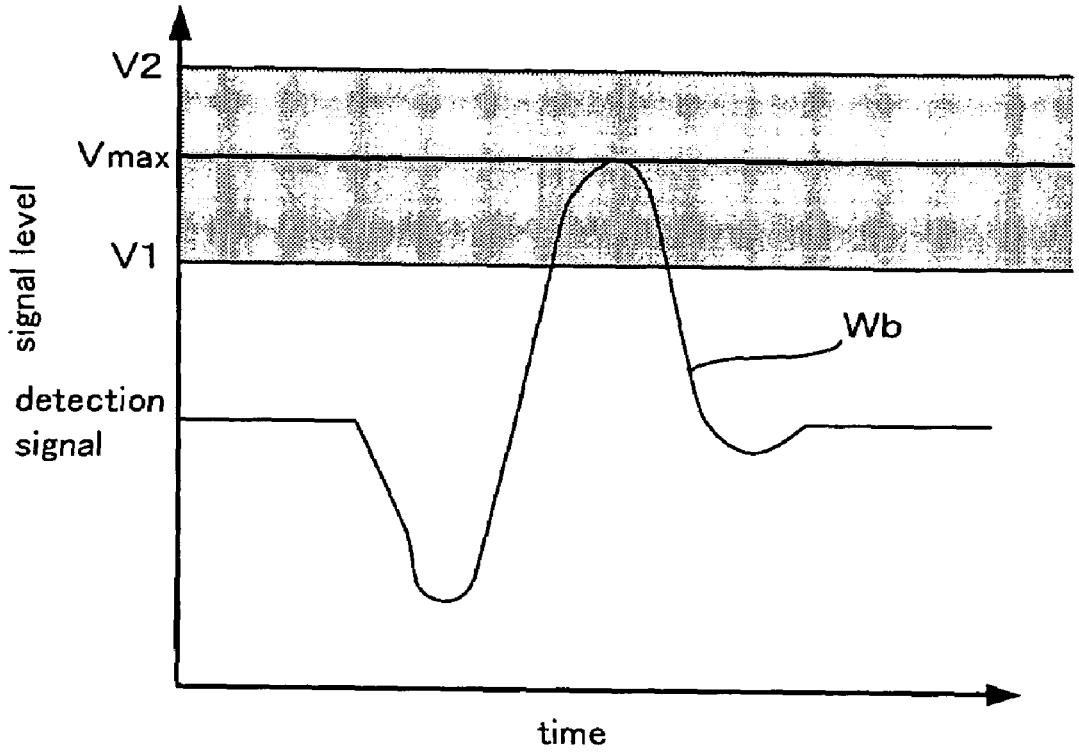
FIG. 13 is an explanatory diagram for explaining an example of the method for determining the direction of ejection of ink.

FIG. 13 shows an example of the inspecting method. In this inspection, a peak value Vmax is acquired from the waveform Wb of the detection signal obtained from the detection section 80. Then, whether or not the peak value Vmax acquired falls within a predetermined allowable range is examined. More specifically, since the peak value Vmax acquired varies with the distance M between the sensing section 70 and the flying path F of an ink drop Ip, it is possible to grasp the distance M between the sensing section 70 and the flying path F of the ink drop Ip if the peak value Vmax is known. Based on this, it is possible to check whether or not the direction of ejection of the ink drop Ip is normal.

Here, the predetermined allowable range is set between a minimum allowable value V1 and a maximum allowable value V2. The minimum allowable value V1 is the lower limit of the peak value Vmax, which defines the upper limit of the distance M between the sensing section 70 and the flying path F of an ink drop Ip. The maximum allowable value V2 is the upper limit of the peak value Vmax, which defines the lower limit of the distance M between the sensing section 70 and the flying path F of an ink drop Ip. These minimum and maximum allowable values V1 and V2 are established to allow a predetermined tolerance with respect to a reference distance between the sensing section 70 and a standard path along which an ink drop Ip is intended to fly. Consequently, if the flying path F of an ink drop Ip deviates largely from the standard path and comes too close to the sensing section 70, the detection signal from the detection section 80 shows a peak value Vmax exceeding the maximum allowable value V2. This makes it possible to determine that the direction of ejection of the ink drop Ip is not normal. If the flying path F of an ink drop Ip is too far from the sensing section 70, the detection signal from the detection section 80 shows a peak value Vmax that falls below the minimum allowable value V1. This makes it possible to determine that the direction of ejection of the ink drop Ip is not normal.

Figure 14A:
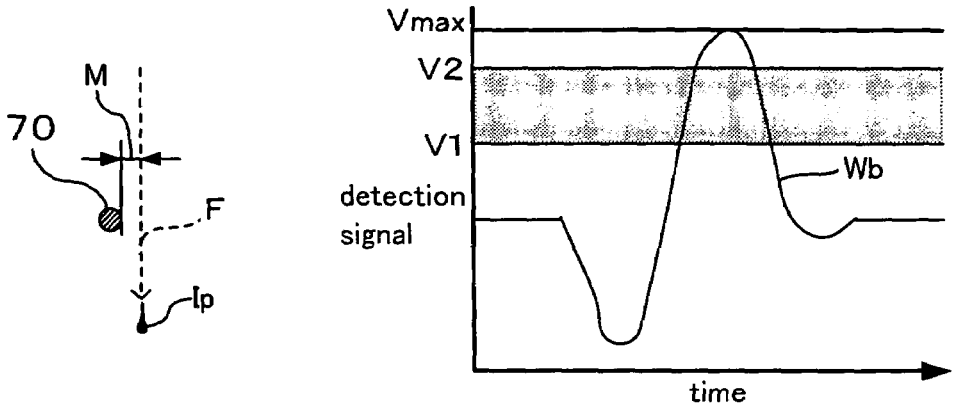
FIG. 14A is a diagram showing a case where the flying path of an ink drop is too close to the sensing section, FIG. 14B a case where the flying path of the ink drop falls within an allowable range, and FIG. 14C a case where the flying path of the ink drop is too far from the sensing section.
Figure 14B:
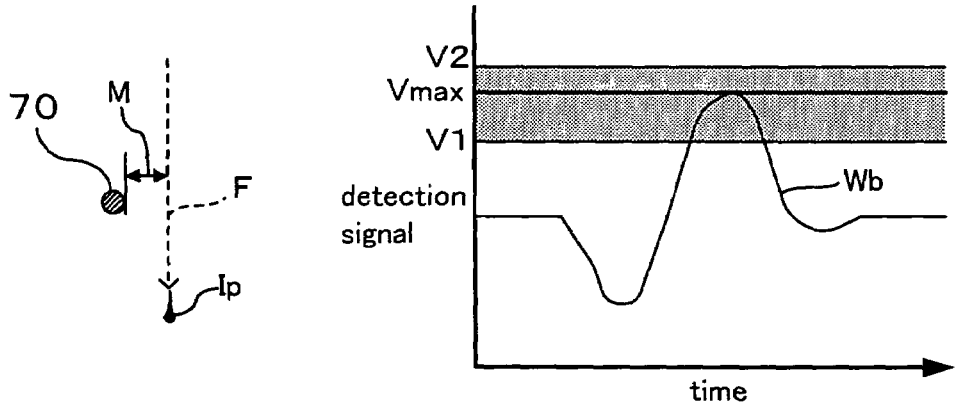
Figure 14C:
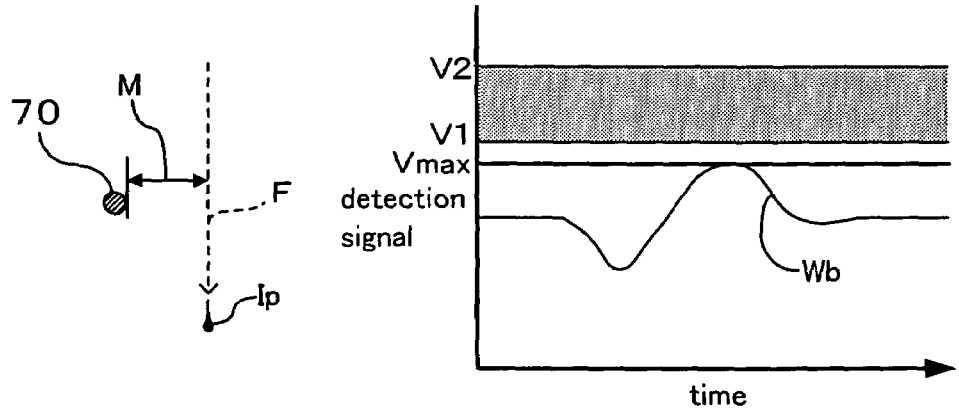

FIGS. 14A to 14C show the relationship between the distance M, which is the distance between the sensing section 70 and the flying path F of an ink drop Ip, and the waveform of the detection signal from the detection section 80. FIG. 14A shows the case where the flying path F of an ink drop Ip is extremely close to the sensing section 70. FIG. 14B shows the case where the flying path F of an ink drop Ip falls within the allowable range. FIG. 14C shows the case where the flying path F of an ink drop Ip is too far from the sensing section 70.

As shown in FIG. 14A, when the flying path F of an ink drop Ip is extremely close to the sensing section 70, the signal waveform of the detection signal from the detection section 80 shows a peak value Vmax that exceeds the upper limit of the predetermined allowable range, i.e., the maximum allowable value V2. It is thus determined that the direction of ejection of the ink drop Ip from that nozzle is not normal.

As shown in FIG. 14B, when the flying path F of an ink drop Ip falls within the allowable range, the signal waveform of the detection signal from the detection section 80 has a peak value Vmax that falls within the predetermined allowable range, i.e., between the minimum allowable value V1 and the maximum allowable value V2. It is thus determined that the direction of ejection of the ink drop Ip from that nozzle is normal.

On the other hand, as shown in FIG. 14C, when the flying path F of an ink drop Ip is too far from the sensing section 70, the signal waveform of the detection signal from the detection section 80 shows a peak value Vmax that falls below the lower limit of the predetermined allowable range, i.e., the minimum allowable value V1. It is thus determined that the direction of ejection of the ink drop Ip from that nozzle is not normal.

Incidentally, the minimum allowable value V1 and the maximum allowable value V2 for defining the predetermined allowable range correspond to the "reference value." The information on the minimum and maximum allowable values V1 and V2 for defining the predetermined allowable range is stored as data in an appropriate storage section such as a memory including the main memory 127. When comparing the peak value Vmax with the minimum allowable value V1 or the maximum allowable value V2, the controller 126 acquires the information on the minimum and maximum allowable values V1 and V2 from the appropriate storage section such as the main memory 127.

In the foregoing, the determination as to whether the direction of ejection of an ink drop Ip is normal or not is made based on the peak value Vmax of the detection signal from the detection section 80. Nevertheless, the method for determining the direction of ejection of an ink drop Ip is not limited to those predicated on the peak value Vmax in the signal level of the detection signal from the detection section 80. As long as the intensity of the induced current occurring in the sensing section 70 is used as a criterion, determination may be made based on any portion of the detection signal from the detection section 80.

Sensing Section According to Present Embodiment

In order for the inkjet printer 1 according to the present embodiment to make an ejection inspection on the nozzles #1 to #180 in each of the nozzle rows 211C, 211M, 211Y, and 211K efficiently, the sensing section 70 is installed as described below.

Figure 15A:
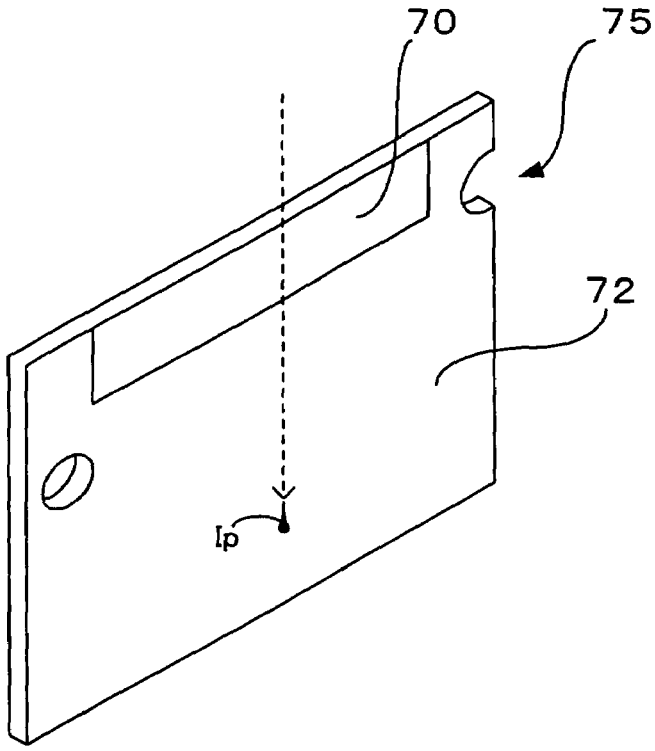
FIG. 15A is a perspective view showing an example of an ejection inspecting unit having the sensing section, and FIG. 15B a perspective view showing the ejection inspecting unit from behind.
Figure 15B:
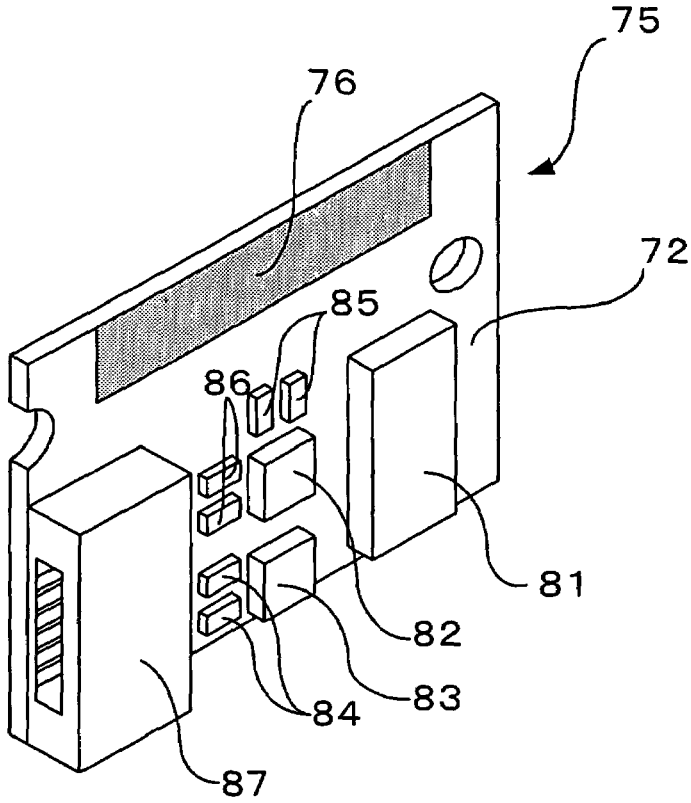

FIGS. 15A and 15B show an example of installation of the sensing section 70 in the inkjet printer 1 according to the present embodiment. The following description will deal with a case where the sensing section 70 is formed on a substrate 72. FIG. 15A shows the substrate 72 provided with the sensing section 70 from the front. FIG. 15B shows the substrate 72 having the sensing section 70 from behind. This substrate 72 is a printed-circuit board.

The sensing section 70 is integrally formed on the substrate 72. For example, a conductive plate-like member such as a metal plate is attached directly to the substrate 72. A thin film pattern may instead be formed on the substrate 72. Here, as shown in FIG. 15A, the sensing section 70 is formed as a strip on one surface of the substrate 72 along the top end of the same. Electrically-charged ink drops Ip ejected from the nozzles #1 to #180 come flying from above the substrate 72 and pass by the sensing section 70 on the substrate 72 to fall down as shown in the diagram. This causes induced currents in the sensing section 70.

Note that the "one surface" of the substrate 72 where the sensing section 70 is formed is free of any protrusions that protrude from the substrate 72, such as electronic parts other than the sensing section 70. The reason for this is that if any protrusions such as electronic parts are formed on the surface of the substrate 72 where the sensing section 70 is formed, they may be tainted with the ink ejected from the nozzles #1 to #180.

Meanwhile, as shown in FIG. 15B, circuit components for constituting the detection section 80 described in FIG. 9 are integrally provided on the other surface of the substrate 72 opposite from the surface where the sensing section 70 is formed. That is, various types of circuit components 81, 82, 83, 84, 85, and 86 for constituting the components of the detection section 80 including the protective resistor R1, the capacitor C, the input resistor R2, the feedback resistor R3, and the operational amplifier Amp are integrally mounted on the other surface. In addition, circuit components (not shown) constituting a voltage application circuit intended to charge the ink drops ejected from the nozzles #1 to #180 with electricity may also be formed on the other surface of the substrate 72. An example of the voltage application circuit is a booster circuit which applies a voltage as high as, e.g., +100 V to the sensing section 70. Consequently, the substrate 72 makes a single ejection inspecting unit 75 on which the sensing section 70, which is for performing an inspection on the ejection of ink from the nozzles #1 to #180, and the circuit components 81, 82, 83, 84, 85, and 86 and a connector 87 are mounted.

Since the various types of circuit components 81, 82, 83, 84, 85, and 86 constituting the detection section 80 and the connector 87 are provided on the side opposite from where the sensing section 70 is provided, it is possible to prevent the circuit components 81, 82, 83, 84, 85, and 86, and the connector 87 from being tainted with the ink ejected from the nozzles #1 to #180.

Moreover, a ground section 76 is formed on the substrate 72 of the present embodiment, on the side opposite from where the sensing section 70 is formed. This ground section 76 is formed at a position corresponding to the sensing section 70 on the opposite surface therefrom so that it comes right on the opposite side from the position where the sensing section 70 is formed. Like the sensing section 70 formed on the other side, this ground section 76 is formed as a stripe along the top end of the substrate 72. In this example, the ground section 76 is given the same shape and the same size as those of the sensing section 70. Like the sensing section 70, this ground section 76 is also integrally formed on the substrate 72. For example, a conductive plate-like member such as a metal plate may be attached directly to the substrate 72. Instead, a thin film pattern may be formed on the substrate 72. Incidentally, this ground section 76 is grounded via a not-shown wiring section or the like.

Since such a ground section 76 is formed on the surface opposite from where the sensing section 70 is formed, so as to correspond to the position where the sensing section 70 is formed, it is possible to shield the sensing section 70 from behind so that the sensing section 70 is prevented from being affected by external noise. This makes it possible to prevent induced currents not related to the ejection inspection from occurring as noise in the sensing section 70 due to external noise. Consequently, induced currents that are caused by ink drops Ip ejected from the nozzles #1 to #180 can be detected from the sensing section 70. Whether or not ejection of ink is being performed normally at the nozzles #1 to #180 can thus be determined more accurately.

Figure 16A:
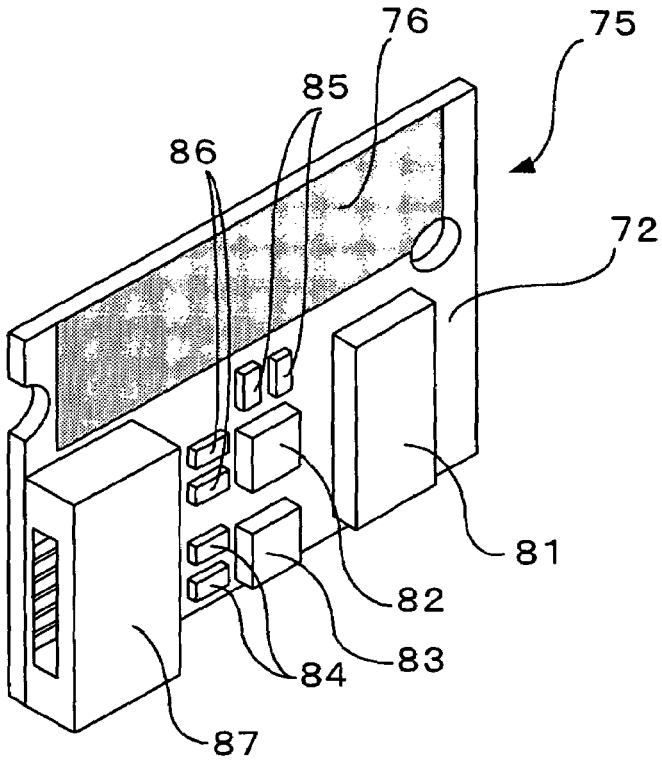
FIG. 16A is a perspective view for explaining an example of another type of ground section.

Incidentally, this ground section 76 need not necessarily be formed in the same size as that of the sensing section 70. FIG. 16A shows an example where the ground section 76 is formed in a size different from that of the sensing section 70. Here, the ground section 76 is given a size greater than in FIG. 15. The area of the ground section 76 is increased both in the horizontal and vertical directions. When the ground section 76 is thus given a greater size, it is possible to increase the shielding effect on the sensing section 70. This allows further prevention of the adverse effect of external noise on the sensing section 70. As a result, whether or not ejection of ink drops Ip is being performed normally at the nozzles #1 to #180 can be determined more accurately.

Figure 16B:
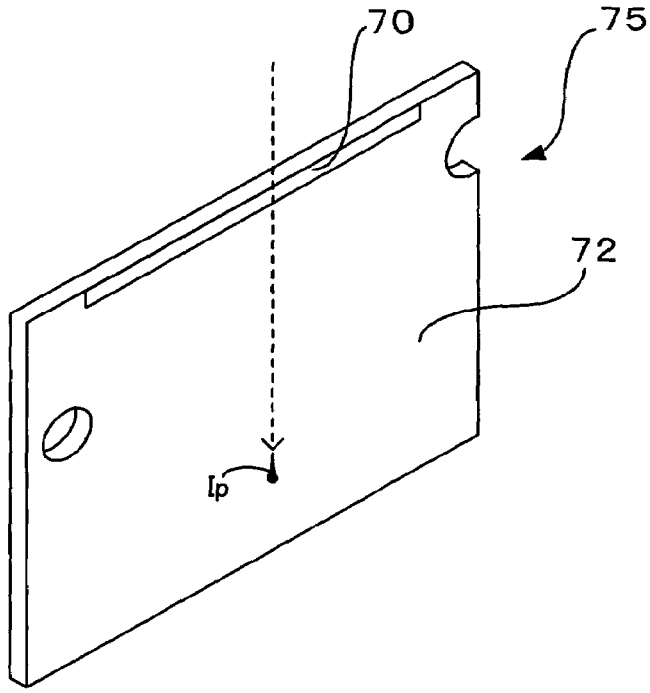
FIG. 16B is a perspective view of an ejection inspecting unit having another type of sensing section.

Moreover, the sensing section 70 is not necessarily limited to the strip shape as shown in FIG. 15A. FIG. 16B shows an example where the sensing section 70 is formed in a different shape than the foregoing. Here, the sensing section 70 is formed as a thin line pattern on the upper edge of the substrate 72. That is, the sensing section 70 is given a width smaller than in the foregoing case. Even when the sensing section 70 is thus formed in a line shape with a smaller width, the electrically-charged ink ejected from the nozzles #1 to #180 can cause an induced current in the sensing section 70. It is therefore possible to perform an ejection inspection on the nozzles #1 to #180 smoothly.

Position of Installation of Sensing Section

Figure 17:
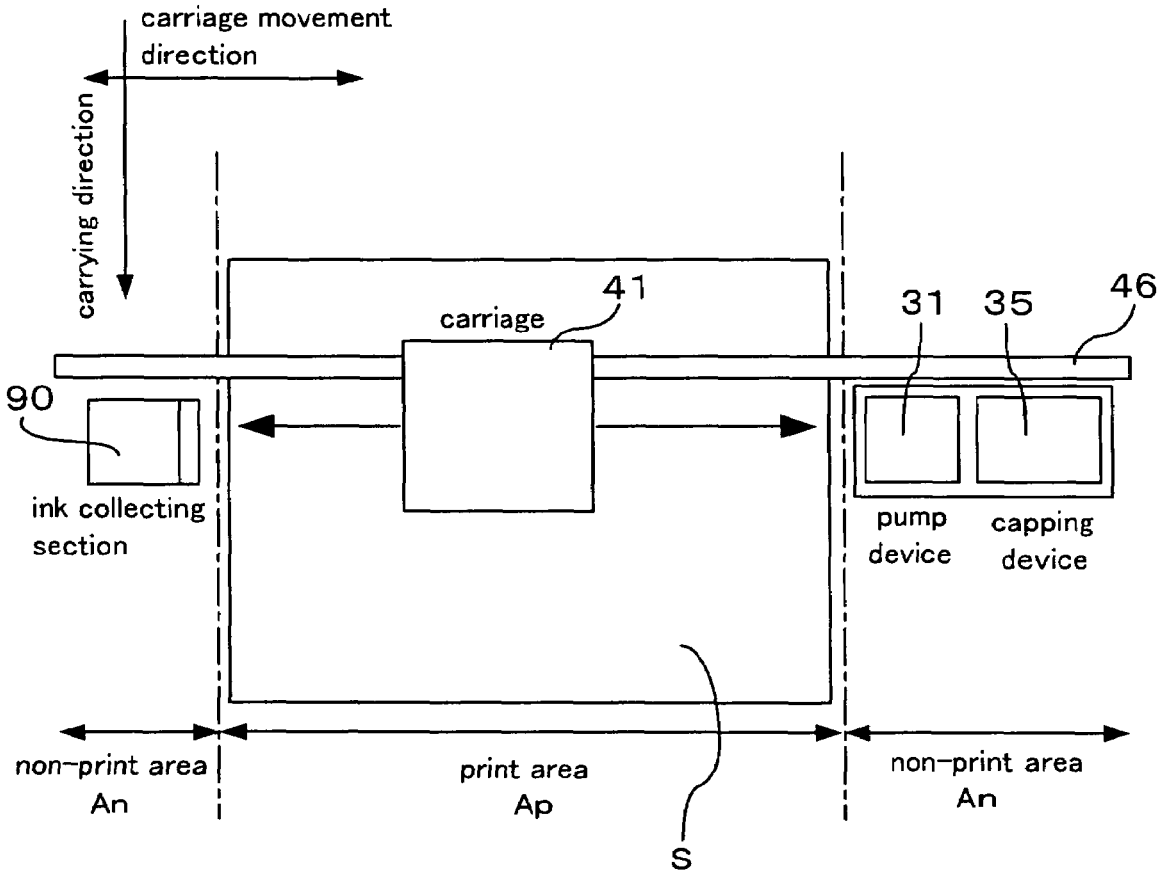
FIG. 17 is an explanatory diagram showing the position of an ink collecting section in which the ejection inspecting unit is installed.

FIG. 17 shows in detail the position where the ejection inspecting unit 75 having the sensing section 70 is installed. The ejection inspecting unit 75 of the present embodiment is installed in an ink collecting section 90. The ink collecting section 90 is arranged in an area An (hereinafter, referred to as non-print area An) off the print area Ap where the nozzles #1 to #180 eject ink for printing. (In this example, the ink collecting section 90 is arranged in the non-print area An on the left of the print area Ap.) This ink collecting section 90 is formed for flushing purpose. Here, "flushing" refers to processing for draining ink by performing an operation of ejecting ink from each of the nozzles #1 to #180 of the head 21 forcefully. Specifically, the piezoelectric devices in the respective nozzles #1 to #180 are driven to eject ink from the nozzles #1 to #180 intentionally in the same manner as when ejecting ink from the nozzles #1 to #180 for printing. Such an operation is performed to resolve ejection failures of the nozzles #1 to #180 such as clogging. This flushing is sometimes performed during printing. More specifically, while the carriage 41 moves in the carriage movement direction and ejects ink for printing, the carriage 41 is moved above the ink collecting section 90 to perform the flushing by ejecting ink from the nozzles #1 to #180 forcefully. Subsequently, the carriage 41 moves again in the carriage movement direction and ejects ink for printing. The ink collecting section 90 is formed for the purpose of collecting the ink drained from the nozzles #1 to #180 during flushing which is thus performed in the process of printing or the like.

Meanwhile, a pump device 31 is installed in the non-print area An on the right of the print area Ap. The pump device 31 is a device for cleaning the nozzles #1 to #180, and sucks out ink from the nozzles #1 to #180 in order to resolve nozzle clogging. A capping device 35 is also arranged in this non-print area An. The capping device 35 covers and caps the nozzles #1 to #180 of the head 21 when not printing. Aside from these pump device 31 and capping device 35, various devices may also be provided including a wiping device for wiping off excessive ink adhering to the openings of the nozzles #1 to #180.

To perform an ejection inspection as to whether or not ejection of ink is being normally performed at the nozzles #1 to #180 in each of the nozzle rows 211C, 211M, 211Y, and 211K of the head 21, the carriage 41 moves toward the ink collecting section 90 along the carriage movement direction. Then, when the carriage 41 reaches the position above the ink collecting section 90, the nozzles #1 to #180 in each of the nozzle rows 211C, 211M, 211Y, and 211K eject ink individually for an ejection inspection.

Figure 18:
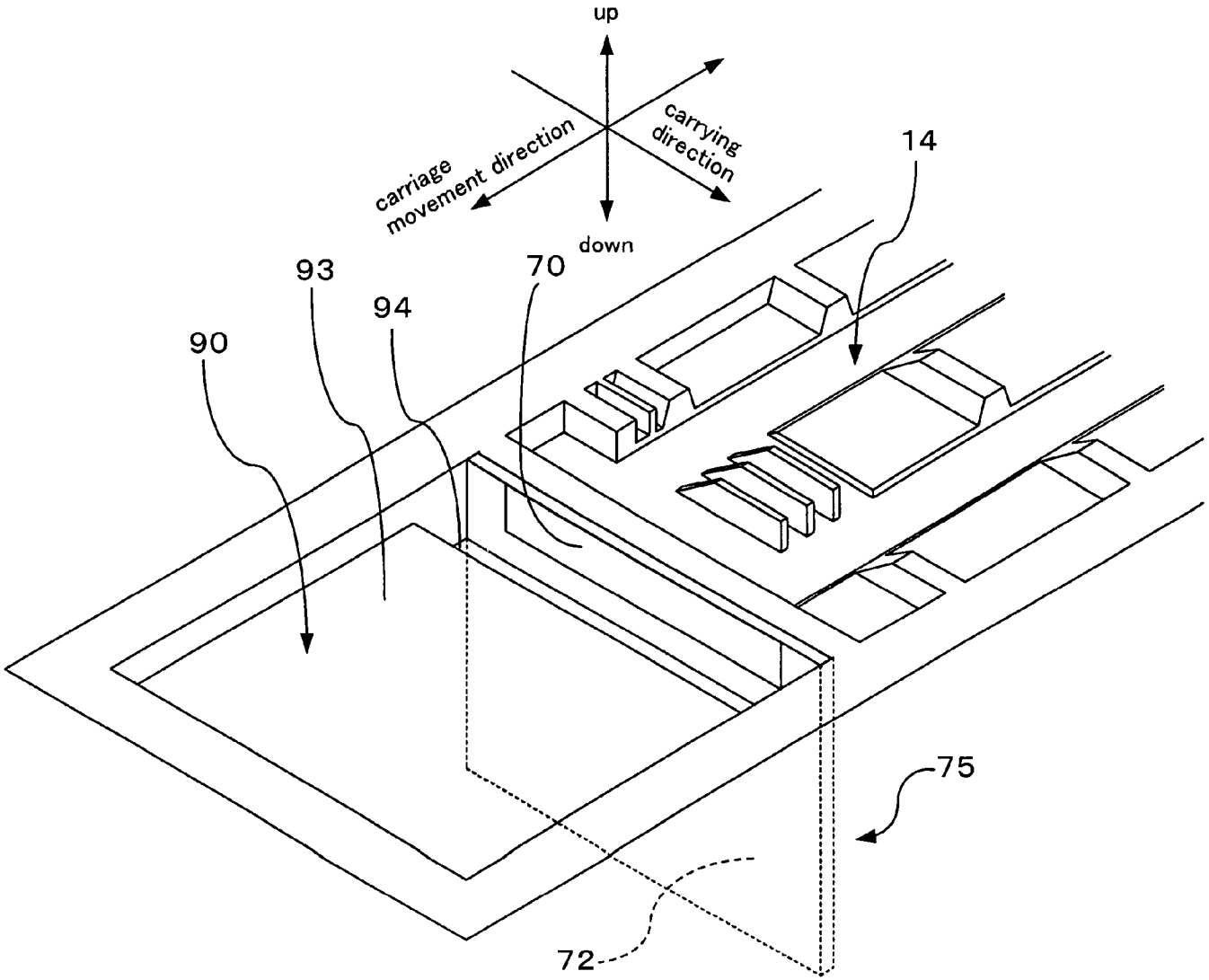
FIG. 18 is a perspective view for explaining the installation position of the ejection inspecting unit.
Figure 19:
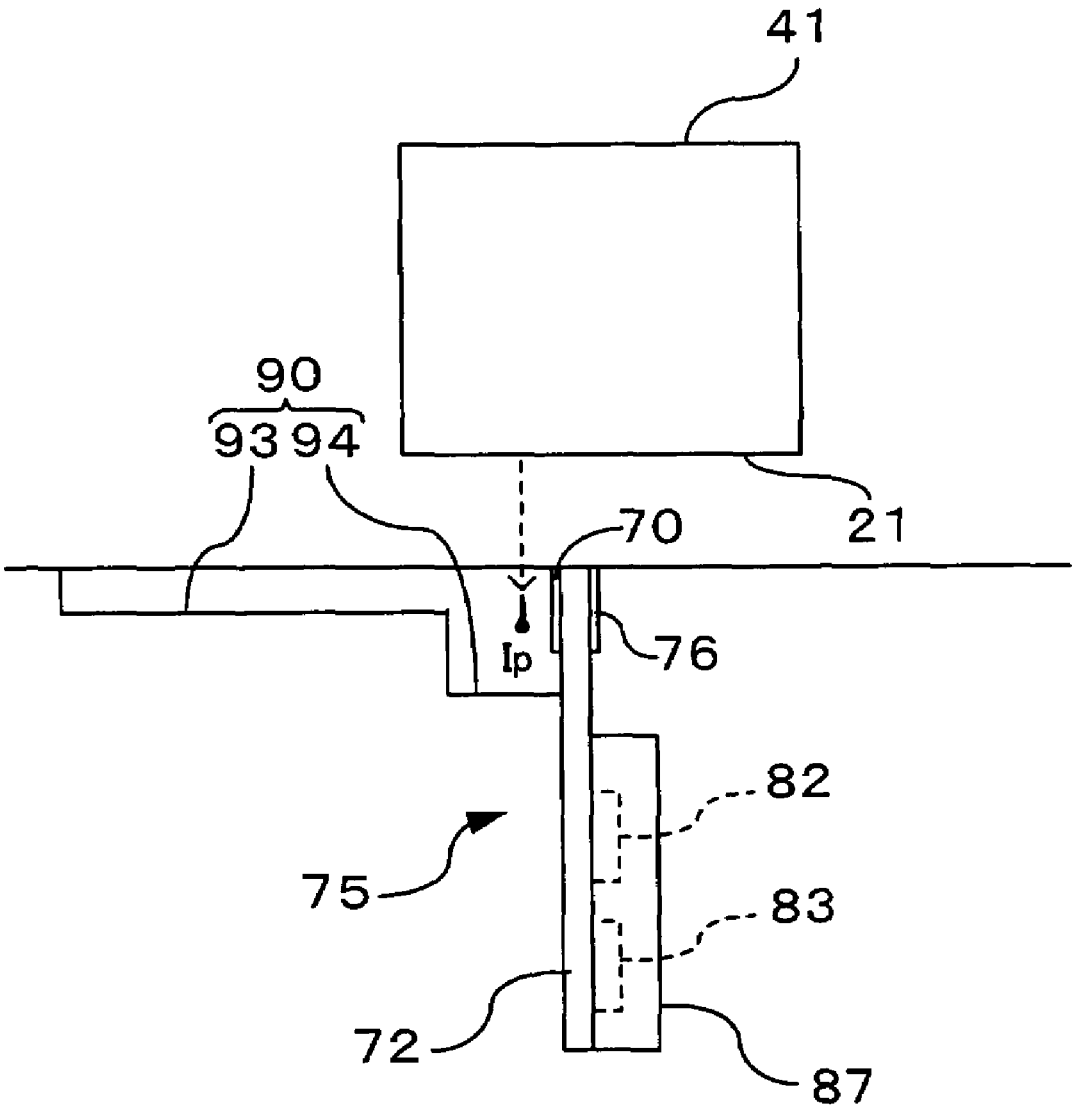
FIG. 19 is a longitudinal sectional view for explaining the installation position of the ejection inspecting unit.

FIGS. 18 and 19 show the ink collecting section 90 in detail. FIG. 18 is a perspective view of the ink collecting section 90. FIG. 19 is a longitudinal sectional view of the ink collecting section 90. As shown in FIG. 18, this ink collecting section 90 is formed next to the platen 14 where the medium S is printed. As shown in FIGS. 18 and 19, this ink collecting section 90 has two recesses 93 and 94 for collecting ink ejected from the nozzles #1 to #180. The first recess 93 is shallow, whereas the other second recess 94 is deep. These first and second recesses 93 and 94 are formed next to each other along the direction of movement of the carriage 41.

As shown in FIGS. 18 and 19, the ejection inspecting unit 75 is installed in the second recess 94 and arranged perpendicularly downward from the second recess 94. The sensing section 70 is thus located in parallel with the direction in which the ink is ejected from the nozzles #1 to #180. As shown in FIG. 18, the ejection inspecting unit 75 is also arranged along the carrying direction. The sensing section 70 is thus arranged in parallel with the nozzle rows 211C, 211M, 211Y, and 211K of the head 21. The sensing section 70 is exposed to the inside of the second recess 94.

Meanwhile, the circuit components 82 and 83 (81, 84) and the connector 87 are formed on the surface of the substrate 72 opposite from the sensing section 70. That is, as shown in FIG. 19, they are located on a surface opposite from the surface of the sensing section 70 where ink ejection takes place, and thus are hidden and covered from the front side where ink is ejected from the nozzles #1 to #180. This makes it possible to prevent the circuit components 82 and 83 (81, 84) and the connector 87 from being tainted with the ink ejected from the nozzles #1 to #180.

When an ejection inspection is performed on the nozzles #1 to #180, the ink ejected from the individual nozzles #1 to #180 passes by the sensing section 70 and falls into the second recess 94 of the ink collecting section 90. The ink ejected from the nozzles #1 to #180 for the sake of an ejection inspection can thus be collected smoothly, thereby preventing the interior of the inkjet printer 1 from being tainted.

Positional Relationship between Ejection Inspecting Unit and Nozzle Rows

Figure 20:
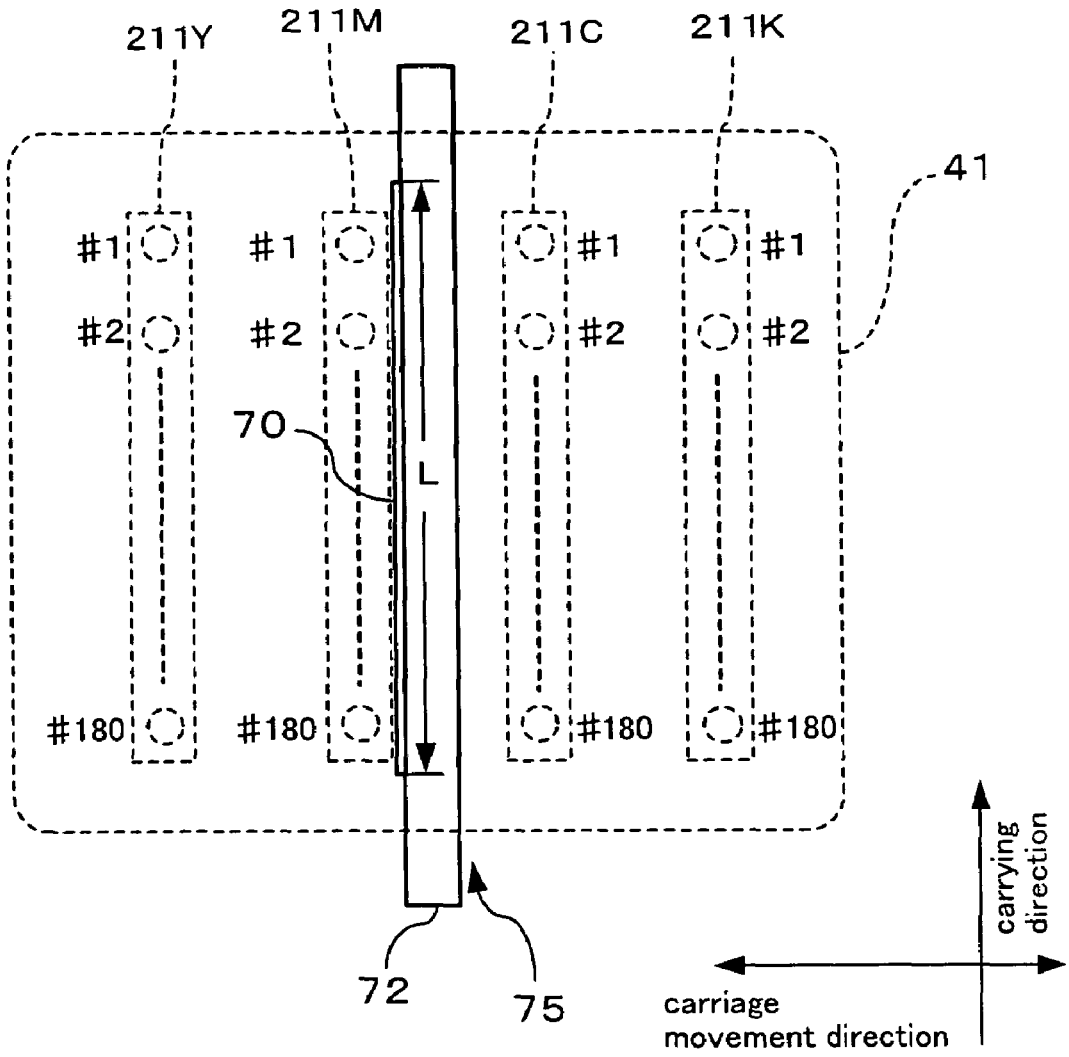
FIG. 20 is an explanatory diagram showing an example of the physical relationship between the sensing section and the nozzle rows during an ejection inspection.

FIG. 20 shows the positional relationship between the ejection inspecting unit 75 and the nozzle rows 211C, 211M, 211Y, and 211K of the head 21 during an ejection inspection. As shown in the diagram, the sensing section 70 formed in the ejection inspecting unit 75 is arranged in parallel with the nozzle rows 211C, 211M, 211Y, and 211K of the head 21. The length L of the sensing section 70 basically corresponds to that of the nozzle rows 211C, 211M, 211Y, and 211K, and is set to a length somewhat greater than the length of the nozzle rows.

When performing an ejection inspection, as shown in the diagram, one of the plurality of nozzle rows 211C, 211M, 211Y, and 211K formed in the head 21 (here, the nozzle row 211M) is positioned to lie above but slightly off the sensing section 70. After the positioning is completed, the nozzles #1 to #180 of the nozzle row 211M eject ink toward the side of the sensing section 70 individually for the sake of an ejection inspection.

After the ejection inspection on one nozzle row (here, the nozzle row 211M) is completed, the carriage 41 is moved to perform an ejection inspection on the next nozzle row yet to be inspected. The sensing section 70 and the next nozzle row to be inspected (here, the nozzle row 211Y etc.) are then positioned to each other, and an ejection inspection is performed on that nozzle row. In this way, the plurality of nozzle rows formed in the head 21 are subjected to an ejection inspection row by row in succession.

Inspection Timing

The possible timings for performing the ejection inspection include the following:

(1) During Printing

An ejection inspection is performed at appropriate timing during printing. For example, in the case of "bidirectional printing," the carriage 41 is moved to a waiting position and an ejection inspection is performed on the nozzles #1 to #180 when the movement direction is switched. This makes it possible to prevent nozzle clogging and the like from occurring in the process of printing, and causing troubles on the printed images.

(2) On Power-Up

An ejection inspection is performed upon power-up. That is, an ejection inspection is performed when the inkjet printer 1 (printing apparatus) is powered up in order to start printing. The ejection inspection is performed on the nozzles #1 to #180 as one of the initialization processes of the inkjet printer 1. When the ejection inspection is executed at this timing, it is possible to perform printing smoothly without clogging and the like of the nozzles #1 to #180.

(3) When Supplying Paper

An ejection inspection is performed at the time of operation for feeding a medium S into a predetermined position for printing, i.e., when supplying paper. Here, whether ink is ejected normally or not is checked when printing is about to be performed on a single medium S. The ejection inspection may be performed each time a medium S is fed, or at appropriate intervals like every predetermined number of sheets.

(4) When Acquiring Print Data

An ejection inspection is performed when the inkjet printer 1 receives print data from the host computer 140 such as a personal computer. That is, whether ink is ejected normally or not is checked when print data is received from the host computer 140 and printing is about to be performed. When the ejection inspection is executed at this timing, it is possible to perform printing smoothly without clogging and the like of the nozzles #1 to #180.

Incidentally, the ejection inspections of the present invention need not necessarily be performed at the foregoing timings (1) to (4). Ejection inspections may also be performed at timings other than the foregoing (1) to (4).

Overview

As has been described, according to the foregoing liquid ejection inspecting apparatus, whether or not ink is normally ejected from the nozzles #1 to #180 can be determined easily by making the operation of ejecting electrically-charged ink from the nozzles #1 to #180 of the head 21 and examining if induced currents occur in the sensing section 70. The apparatus thus has an extremely compact configuration, which does not require a large installation space nor cause a significant increase in cost.

In addition, the sensing section 70 is provided on one surface of the substrate 72 of the substrate 72 while the circuit components 81, 82, 83, 84, 85, and 86 of the detection section 80 (detection circuit) and the connector 87 are formed on the other surface of the substrate 72. This configuration can prevent the circuit components 81, 82, 83, 84, 85, and 86, and the connector 87 from being tainted with the ink ejected from the nozzles #1 to #180.

In addition, the sensing section 70 has a sensing surface that is arranged along the direction of ejection of ink from the nozzles #1 to #180. This makes it easier for induced currents to occur in the sensing section 70. Consequently, the electrically-charged ink ejected from the nozzles #1 to #180 can be favorably sensed by the sensing section 70. As a result, whether or not ink is normally ejected from the nozzles #1 to #180 can be determined with higher accuracy.

When such a liquid ejection inspecting apparatus is mounted on a liquid ejection apparatus like the inkjet printer 1 described above, it is possible to perform ejection inspections extremely easily and resolve ejection failures without much trouble or difficulty.

In addition, since the ink need not necessarily be brought into contact with the sensing section 70, it is possible to avoid ink splashing and spattering due to ejection inspections. As a result, the interior of the apparatus can be prevented from being tainted with ink.

Other Examples of Configuration of the Inspecting Apparatus (Example 1)

<I: Use of Frictional Electrification>

Figure 21:
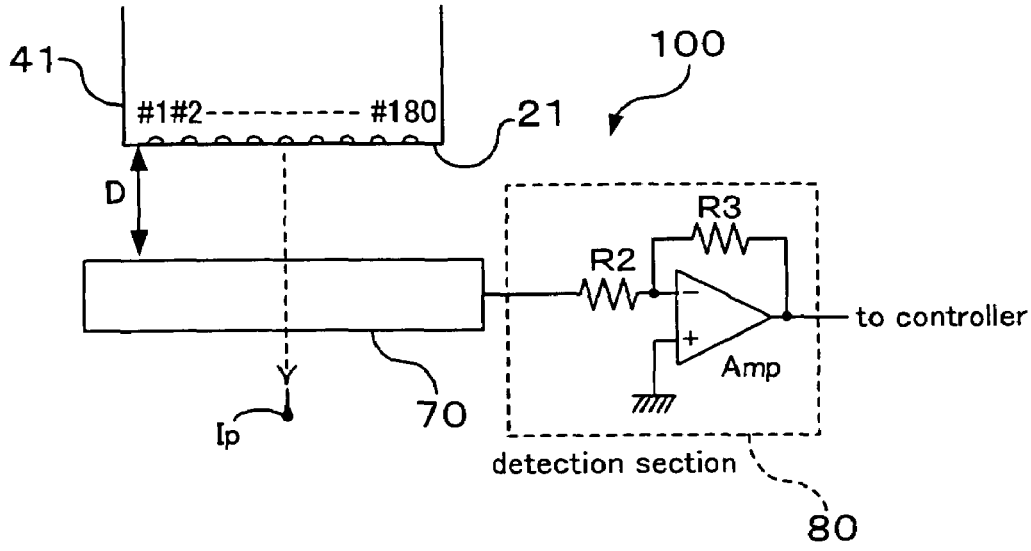
FIG. 21 is a diagram for explaining another example of configuration of the liquid ejection inspecting apparatus.

FIG. 21 shows another example of configuration of the liquid ejection inspecting apparatus according to the present invention. As shown in the diagram, this liquid ejection inspecting apparatus 100 will not charge the ink drops Ip ejected from the nozzles #1 to #180 by applying a high voltage to the sensing section 70 where induced currents occur as in the liquid ejection inspecting apparatus described previously (see FIGS. 9 and 10). Instead, the ink drops Ip ejected from the nozzles #1 to #180 are charged by using a phenomenon so-called frictional electrification in which the ink drops Ip are spontaneously charged with electricity when leaving the nozzles #1 to #180. The configuration for applying a high voltage to the sensing section 70 for the purpose of charging the ink drops Ip is thus omitted.

When the frictional electrification is utilized to charge the ink drops Ip ejected from the nozzles #1 to #180 with electricity, it is possible to simplify the configuration of the liquid ejection inspecting apparatus 100.

Incidentally, since the sensing section 70 of this liquid ejection inspecting apparatus will not undergo high voltages, the capacitor C arranged in the detection section 80 of the liquid ejection inspecting apparatus 60 described previously (see FIGS. 9 and 10) is omitted.

<II: Installation of Electrode Section>

Figure 22:
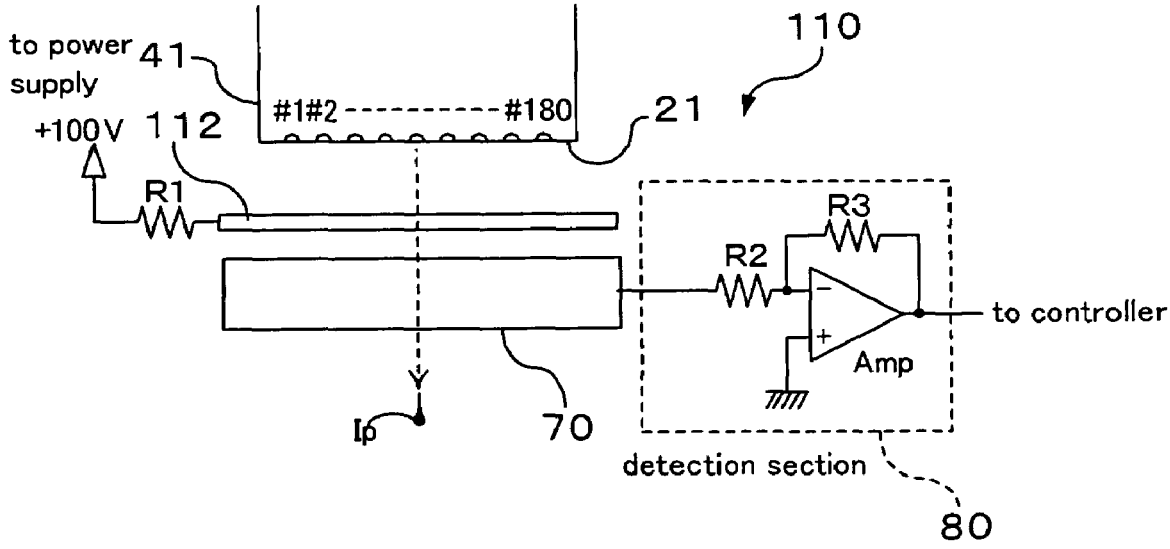
FIG. 22 is a diagram for explaining another example of configuration of the liquid ejection inspecting apparatus.

FIG. 22 shows another example of configuration of the liquid ejection inspecting apparatus according to the present invention. As shown in the diagram, this liquid ejection inspecting apparatus 110 has an electrode section 112 aside from the sensing section 70, so that the ink drops Ip ejected from the nozzles #1 to #180 are electrically charged by this electrode section 112. As shown in the diagram, this electrode section 112 is made of a conductive wire member of metal or the like, and is stretched across tightly in parallel with the head 21. The electrode section 112 is connected to a power supply (not shown) through a protective resistor R1. A high voltage of, e.g., 100 V is applied from this power supply.

Since the provision of the electrode section 112 creates an electric field between the head 21 and the electrode section 112, ink drops Ip can be charged with electricity when leaving the nozzles #1 to #180.

In this case, circuit components (not shown) constituting a voltage application circuit intended to charge the ink drops ejected from the nozzles #1 to #180 with electricity may also be formed on the side of the substrate 72 opposite from where the sensing section 70 is formed. An example of the voltage application circuit is a booster circuit which applies a voltage as high as, e.g., +100 V to the electrode section 112.

Other Examples of Configuration of the Inspecting Apparatus (Example 2)

Figure 23:
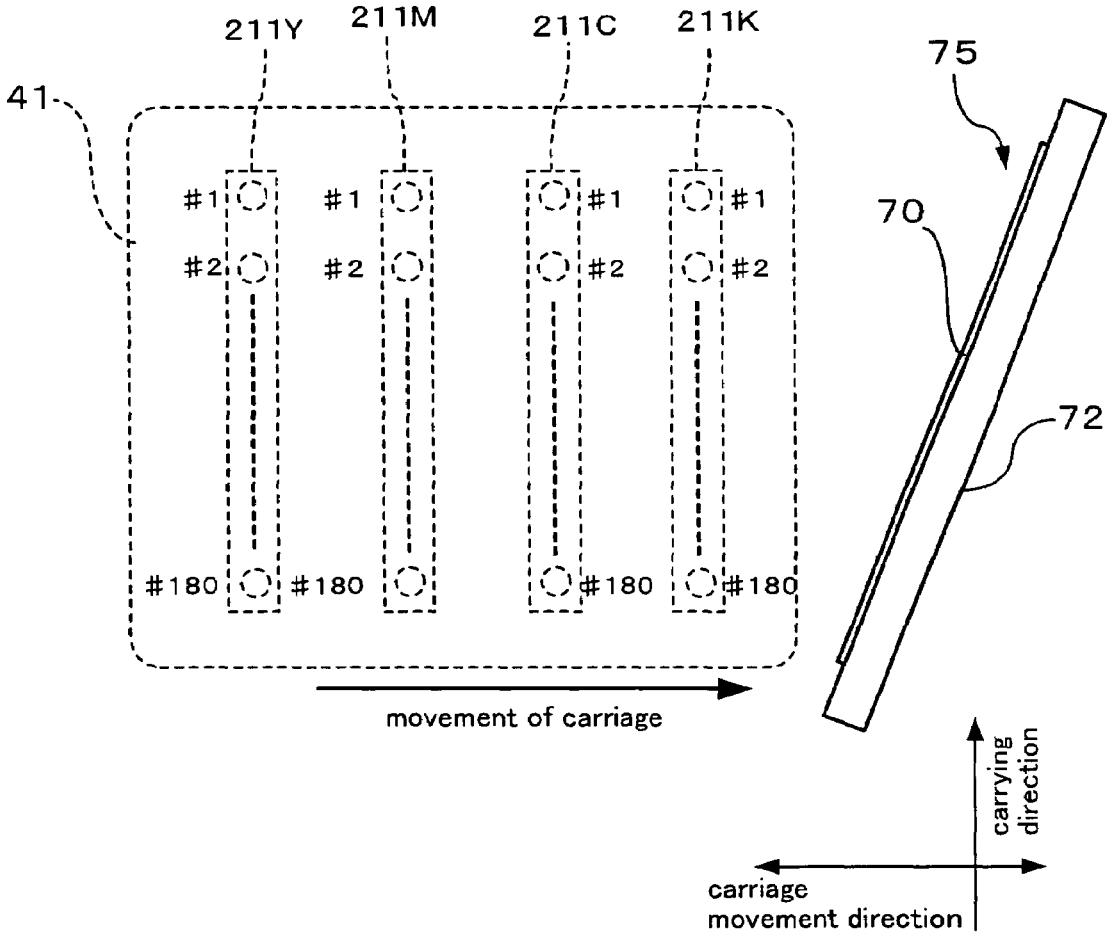
FIG. 23 is a diagram for explaining another example of configuration of the liquid ejection inspecting apparatus.

FIGS. 23 to 24 show another embodiment of the liquid ejection inspecting apparatus. In this liquid ejection inspecting apparatus, as shown in FIG. 23, the sensing section 70 is arranged obliquely to the nozzle rows 211C, 211M, 211Y, and 211K, not in parallel with the nozzle rows 211C, 211M, 211Y, and 211K. That is, the sensing section 70 is arranged in a direction intersecting with the length direction of the nozzle rows 211C, 211M, 211Y, and 211K.

Description will now be given of the ejection inspecting method for situations where the sensing section 70 is arranged as described above. To perform an ejection inspection, the carriage 41 is moved toward the ejection inspecting unit 75 as shown in FIG. 23. When the carriage 41 reaches the ejection inspecting unit 75 and one of the nozzle rows 211C, 211M, 211Y, and 211K in the head 21 reaches above the sensing section 70, a nozzle closest to the sensing section 70 out of the nozzles #1 to #180 in that nozzle row ejects an ink drop Ip to or near to the sensing section 70.

Figure 24A:
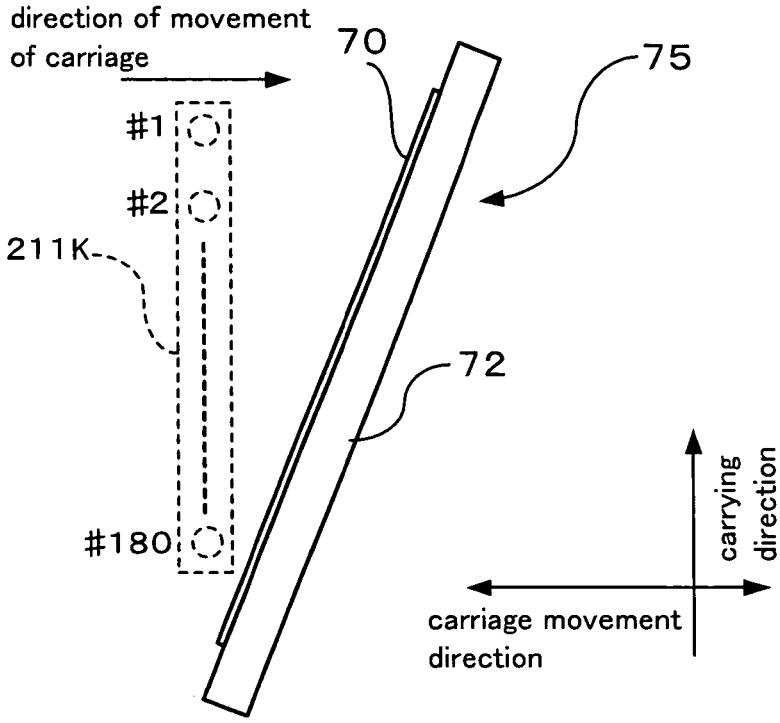
FIG. 24A is an explanatory diagram showing the physical relationship when performing an ejection inspection on the nozzle #180 of the black nozzle row.
Figure 24B:
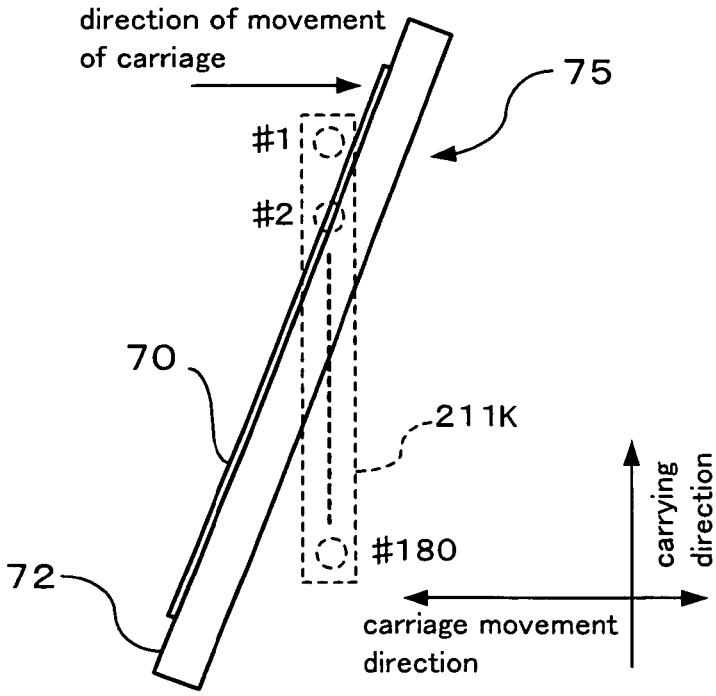
FIG. 24B is an explanatory diagram showing the physical relationship when performing an ejection inspection on the nozzle #1 of the black nozzle row.

FIG. 24A shows the case where the black nozzle row 211K approaches the sensing section 70 and reaches near above the sensing section 70. Among the nozzles #1 to #180 of the black nozzle row 211K, the nozzle #180 which is the closest to the sensing section 70 initially ejects an ink drop Ip toward the sensing section 70. When the carriage 41 is moved further, then the nozzle #179 approaches the sensing section 70. Here, the nozzle #179 ejects an ink drop Ip toward the sensing section 70. In this way, the carriage 41 is moved while the individual nozzles #1 to #180 of the black nozzle row 211K eject ink drops Ip toward the sensing section 70 in succession. Finally, as shown in FIG. 24B, the nozzle #1 in the black nozzle row 211K approaches the sensing section 70, and this nozzle #1 ejects an ink drop Ip toward the sensing section 70. The same ejection inspection is performed on the other nozzle rows 211C, 211M, and 211Y.

As described above, the sensing section 70 is arranged obliquely to the nozzle rows 211C, 211M, 211Y, and 211K in a direction intersecting with the longitudinal direction of the nozzle rows 211C, 211M, 211Y, and 211K. It is therefore possible to perform an ejection inspection on each of the nozzles #1 to #180 in the nozzle rows 211C, 211M, 211K, and 211Y while moving the carriage 41.

Since the sensing section 70 is installed obliquely to the nozzle rows 211C, 211M, 211Y, and 211K, it is even possible to inspect the directions of ejection of ink drops Ip for deviations that occur along the direction of arrangement of the nozzles #1 to #180 in the individual nozzle rows 211C, 211M, 211Y, and 211K. Consequently, it is possible to detect such deviations in the directions of ejection of ink drops Ip as deviations in a direction intersecting with the direction of movement of the carriage 41, i.e., in the carrying direction of the medium S, for example. Since the deviations in the directions of ejection of ink drops Ip toward the carrying direction of the medium S can be detected thus, it is possible to avoid "white stripes" which occur along the direction of movement of the carriage 41 and contribute largely to quality degradation of the printed images.

Incidentally, although the carriage 41 is moved while the nozzles #1 to #180 eject ink drops Ip in succession, the carriage 41 need not necessarily be moved at a predetermined speed, i.e., a constant speed. The carriage 41 may be moved and stopped repeatedly each time the nozzles #1 to #180 eject an ink drop Ip for inspection.

Other Embodiments

<Water Repellant Treatment>

The surface of the sensing section 70 may be treated with a water repellant. When the surface of the sensing section 70 is thus given a water repellant treatment, it is easily possible to remove ink from the surface of the sensing section 70 even if ink droplets Ip ejected from the nozzles #1 to #180 touch the sensing section 70.

Similarly, the surface of the electrode section 112 may also be given a water repellant treatment. This water repellant treatment on the surface of the electrode section 112 can facilitate removing ink from the surface of the electrode section 112 even when ink droplets Ip ejected from the nozzles #1 to #180 adhere to the electrode section 112.

The water repellant treatment may be applied by the method of forming a water repellant treatment layer on the surface of the sensing section 70 or the electrode section 112 by coating or the like, as well as other known methods.

<Grounding Structure of the Head>

Figure 25:
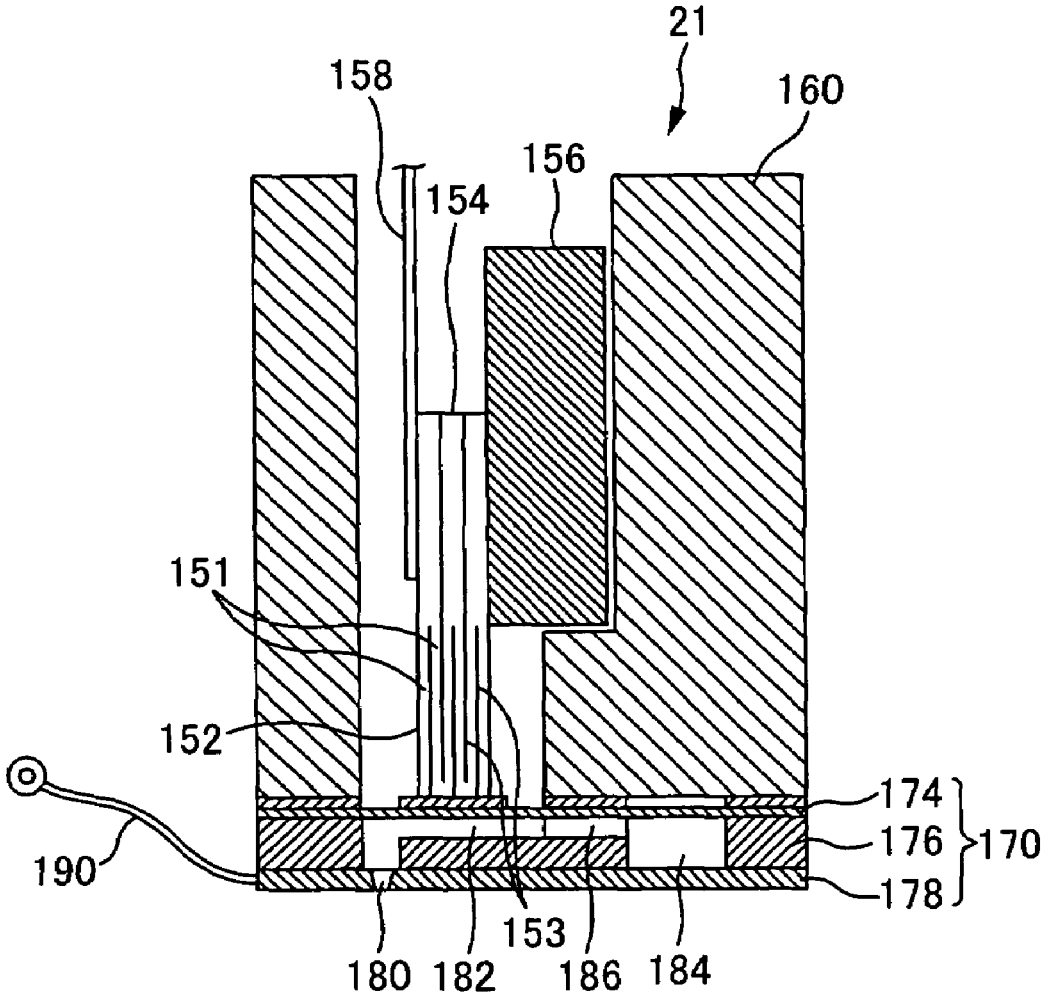
FIG. 25 is a diagram for explaining an example where the head is grounded.

The head 21 described above may be electrically grounded. FIG. 25 is a diagram for explaining an example of the grounding structure of the head 21, showing an example of the internal structure of the head 21. As shown in the diagram, this head 21 comprises a vibrator unit 150, a case 160 capable of accommodating this vibrator unit 150, and a channel unit 170 joined to an end surface of the case 160. The vibrator unit 150 is a single unit composed of a piezoelectric vibrator group 154 consisting of a plurality of piezoelectric vibrators 152, a fixed plate 156, a flexible cable 158, etc.

The piezoelectric vibrators 152 are the piezoelectric devices mentioned above. The piezoelectric vibrators 152 are made of piezoelectric members 151 and internal electrodes 153 laminated alternately, in a thin comb-like shape along the vertical direction. The piezoelectric vibrators 152 extend and contact in the longitudinal direction, i.e., in the vertical direction based on external driving signals. The extremities (lower ends) of the piezoelectric vibrators 152 are joined to the channel unit 170 via island portions 172.

The channel unit 170 is composed of an elastic plate 174, a channel forming substrate 176, and a nozzle plate 178. The nozzle plate 178 is a thin plate of stainless steel or the like, for example, and has a lot of nozzle openings 180 (corresponding to the nozzles #1 to #180) which are formed in a predetermined pitch. These nozzle openings make the nozzles #1 to #180. The channel forming substrate 176 is provided with pressure chambers 182 corresponding to the respective nozzle openings 180.

When the piezoelectric vibrators 152 extend or contract, the elastic plate 174 deforms to curve upward or downward, thereby compressing or expanding the pressure chambers 182. This consequently supplies ink from an ink supply chamber 184 to the pressure chambers 182 through the ink supply channels 186. The ink stored in the pressure chambers 182 is then ejected as ink drops from the nozzle openings 180.

To ground the head 21 having such an ink ejection mechanism, the nozzle plate 178 of the channel unit 170 described above is connected to a ground line 190. This ground line 190 is then connected to an appropriate metal member, such as the guide rail 46 if the guide rail 46 is made of metal. The head 21 can thus be grounded easily by grounding the nozzle plate 178 through the ground line 190.

Configuration of Liquid Ejection System Etc.

Figure 26:
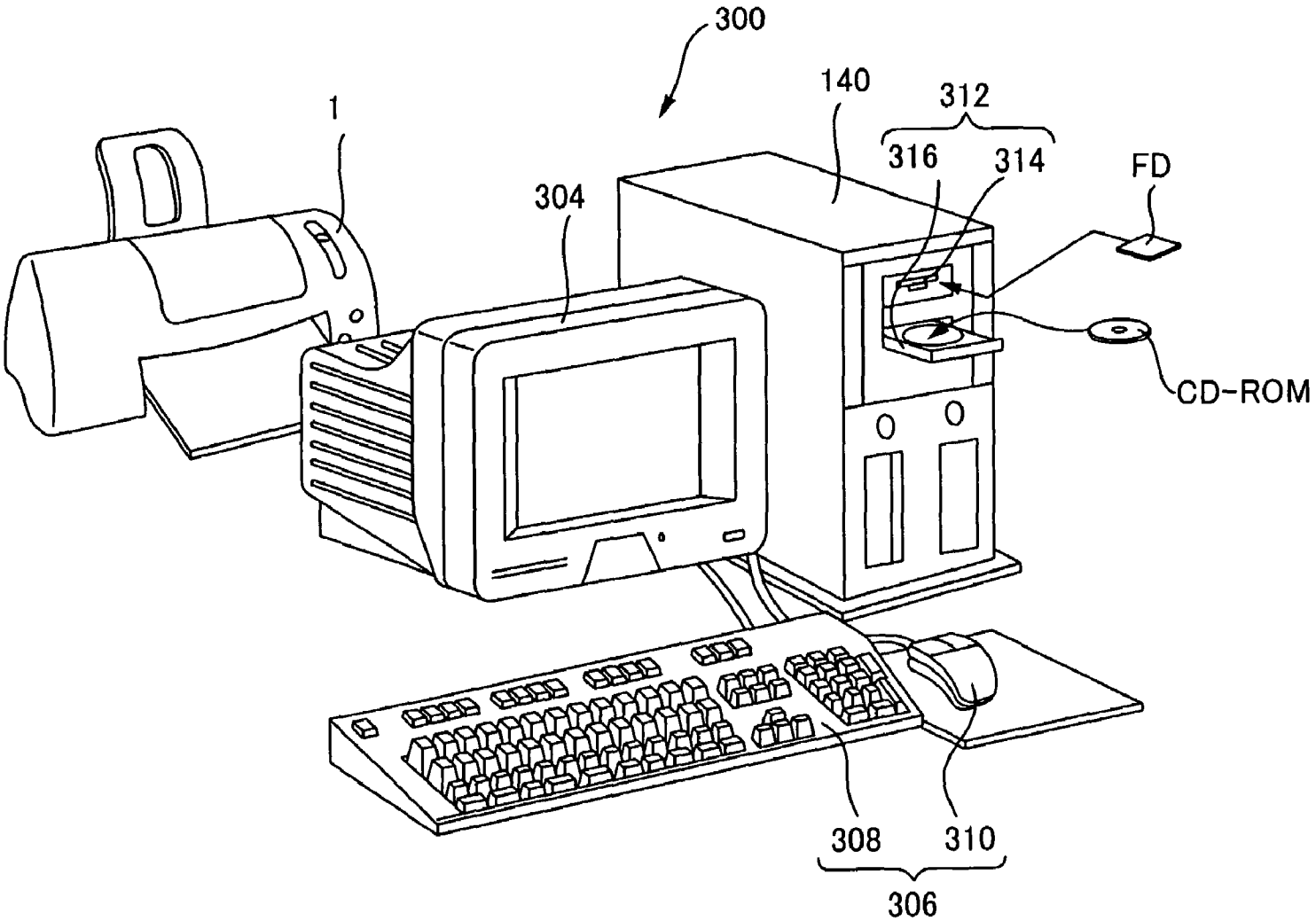
FIG. 26 is a perspective view showing the appearance of an example of a liquid ejection system.

Next, an embodiment of the liquid ejection system will be described with reference to an example where the inkjet printer 1 is provided as the liquid ejection apparatus. FIG. 26 shows the appearance of the embodiment of the liquid ejection system. This liquid ejection system 300 comprises a computer 140, a display device 304, and input devices 306. The computer 140 may use various types of computers including personal computers.

The computer 140 has reading devices 312 such as an FD drive 314 and a CD-ROM drive 316. The computer 140 may also be equipped with other devices such as an MO (Magneto-Optical) disc drive and a DVD drive. The display device 304 may be made of various types of display units such as a CRT display, a plasma display, and a liquid crystal display. The input devices 306 include a keyboard 308, a mouse 310, and the like.

Figure 27:
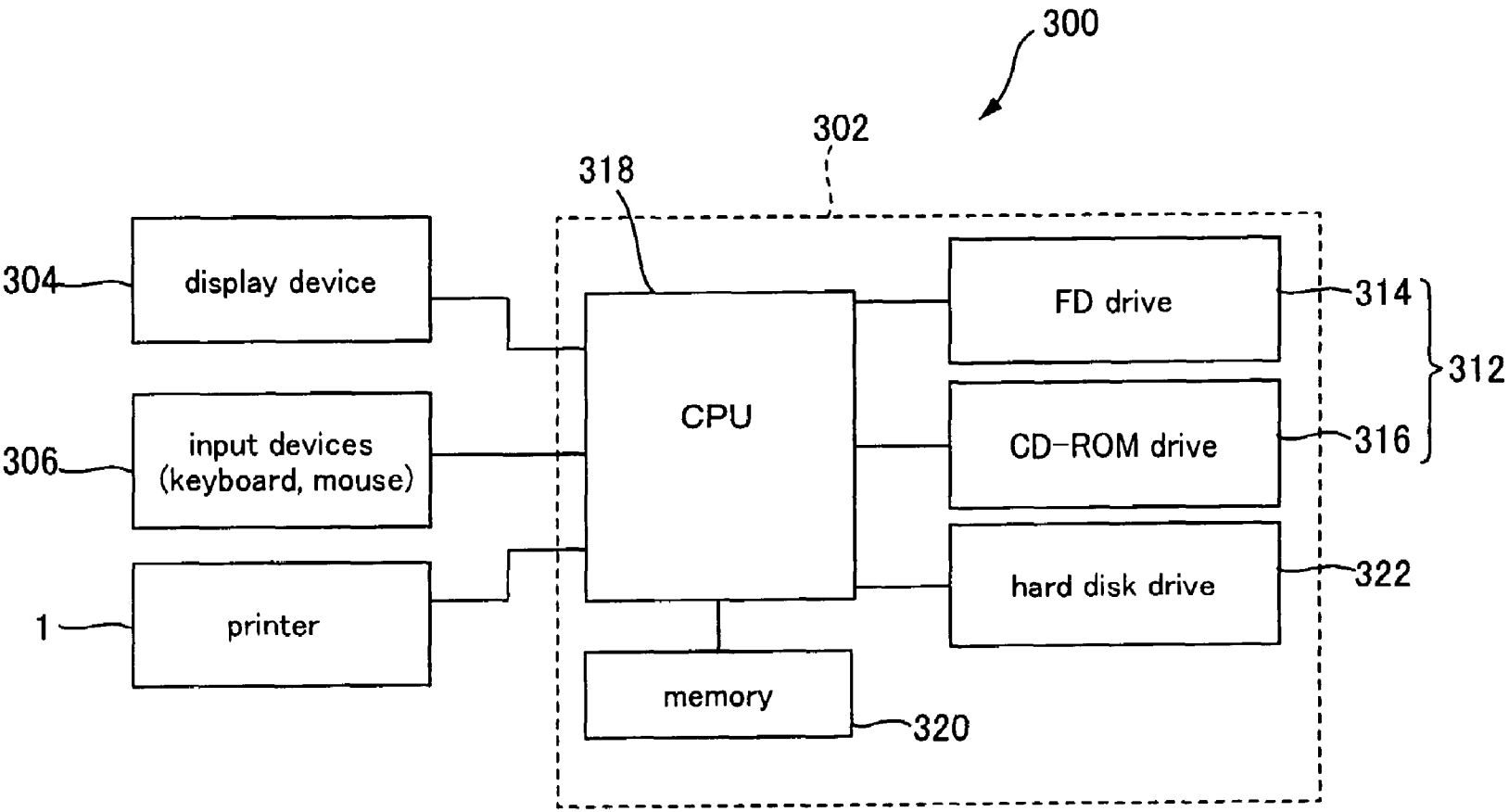
FIG. 27 is a block diagram showing the system configuration of the example of the liquid ejection system.

FIG. 27 is a block diagram showing an example of the system configuration of the liquid ejection system according to the present embodiment. Aside from the reading devices 312 such as the FD drive 314 and the CD-ROM drive 316, the computer 140 also comprises a CPU 318, a memory 320, and a hard disk drive 322.

The CPU 318 controls the entire computer 140. The memory 320 stores various types of data. A printer driver and other programs for controlling the liquid ejection apparatus such as the inkjet printer 1 of this embodiment are installed on the hard disk drive 322. The CPU 318 reads the programs stored in the hard disk drive 322, such as the printer driver, and operates in accordance with the programs. The CPU 318 is also connected with the display device 304, the input devices 306, and the inkjet printer 1 which are located outside the computer 140.

Incidentally, the liquid ejection system 300 achieved thus makes a system superior to conventional systems on the whole.

Other Embodiments

Up to this point, such a printing apparatus as a printer has been described in conjunction with the embodiment thereof. The foregoing embodiment has been given for the sake of easy understanding of the present invention, not for the purpose of providing limited interpretations of the present invention. It is understood that various changes and modifications may be made without departing from the gist of the present invention, and all such equivalents are intended to fall within the scope of the present invention. In particular, embodiments to be described below shall also be covered by the present invention.

<On the Liquids>

The foregoing embodiment has dealt with the case where ink is used as the "liquid." Nevertheless, the liquid is not limited to ink, but a large variety of liquids including metal materials, organic materials (for example, polymeric materials), magnetic materials, conductive materials, wiring materials, deposition materials, electronic inks, various treatment solutions, and genetic solutions may also be used instead of the ink.

<On the Liquid Ejection Nozzles>

The foregoing embodiment has dealt with the ink-ejecting nozzles #1 to #180 as an example of "liquid discharge nozzles." Nevertheless, the "liquid ejection nozzles" are not limited to those for ejecting ink. More specifically, the nozzles may eject various "liquids" other than ink as described above. Examples include ones for ejecting metal materials, organic materials (for example, polymeric materials), magnetic materials, conductive materials, wiring materials, deposition materials, electronic inks, various treatment solutions, and genetic solutions.

The foregoing embodiment has also dealt with the case where the "liquid ejection nozzles," or the nozzles #1 to #180 for ejecting ink, are spaced from each other and arranged on a straight line along the carrying direction of the medium S. The "liquid ejection nozzles" need not necessarily be arranged in this way. That is, the "liquid ejection nozzles" may be arranged in other configurations. The nozzle arrangement and configuration are not limited in particular.

<On the Sensing Section>

The foregoing embodiment has dealt with the case where the sensing section 70 is made of a strip of plate member or a pattern having a width of 2 mm to 3 mm. The "sensing section" is not necessarily limited to such a shape and size. That is, the "sensing section" may be made of a member having a different shape and a different size as long as it is arranged out of contact with the liquid ejection nozzles so that an induced current occurs therein due to electrically-charged liquid ejected from the liquid ejection nozzles.

<On the Detection Circuit>

In the foregoing embodiment, the detection section 80 for detecting induced currents occurring in the sensing section 70 has been described as the "detection circuit." Nevertheless, the "detection circuit" is not limited to the detection section 80 like this. Any type of detection circuit may be used as long as it can detect induced currents occurring in the sensing section 70 due to electrically-charged liquid (ink) ejected from the liquid ejection nozzles (here, the nozzles #1 to #180).

<On the Substrate>

The foregoing embodiment has dealt with the case where the "substrate" is a printed-circuit board. As employed herein, however, the "substrate" is not necessarily limited to such a printed-circuit board. That is, any type of substrate may be used as long as one of its sides is provided with the sensing section which causes an induced current due to electrically-charged liquid ejected from the liquid ejection nozzles, and the other side is provided with the circuit components of the detection circuit which detects the induced current occurring in the sensing section.

<On the Determination Section>

The foregoing embodiment has dealt with the case where the determination as to whether or not ink is normally ejected from the nozzles #1 to #180 is made by the controller 126 which is intended to control the entire inkjet printer 1 (printing apparatus). Nevertheless, whether the ink is normally ejected from the nozzles #1 to #180 or not need not necessarily be determined by the controller 126 like this. That is, the "determination section" for making the determination as to whether or not the ink (liquid) is normally ejected is not limited to this controller 126, but may be a component other than the controller 126. Some dedicated structure for determining whether the ink (liquid) is normally ejected or not may also be provided.

<On the Electrode Section>

In the foregoing embodiment, the electrode section 112 made of a wire member has been described as the "electrode section." Nevertheless, the "electrode section" is not limited to the electrode section 112 like this. Electrode sections of any configuration may be used as long as they can create an electric field with the nozzles #1 to #180 (head 21).

<On the Liquid Ejection Inspecting Apparatus>

The foregoing embodiment has dealt with the case where the liquid ejection inspecting apparatus is mounted on the liquid ejection apparatus such as an inkjet printer. However, the liquid ejection inspecting apparatus is not limited thereto. The liquid ejection inspecting apparatus may be separated from the liquid ejection apparatus so that it can perform only a liquid ejection inspection independently. Moreover, the liquid ejection inspecting apparatus may be mounted on an apparatus other than the foregoing liquid ejection apparatus.

<On the Liquid Ejection Apparatus>

The foregoing embodiment has dealt with the case where the liquid ejection apparatus is the inkjet printer 1. Nevertheless, the liquid ejection apparatus is not limited to the inkjet printer 1 like this, but may be any apparatus as long as it ejects a liquid.

<On the Inks>

The inks to be used may be pigment inks, dye inks, or various other types of inks.

Aside from yellow (Y), magenta (M), cyan (C), and black (K) mentioned above, inks of any other colors may be used including light cyan (LC), light magenta (LM), dark yellow (DY), red, violet, blue, and green, for example.

<On the Printing Apparatus>

The foregoing embodiment has dealt with the case where the printing apparatus is such an inkjet printer 1 as described above. The printing apparatus is not limited thereto, but may be an inkjet printer that ejects ink by other methods.

<On the Medium>

The medium S may be a piece of plain paper, mat paper, a cut sheet, glossy paper, a roll sheet, photo paper, and a roll of photo paper, as well as an OHP film, a glossy film, other film materials, a fabric, a metal plate, and so on. That is, any media may be used as long as they can be printed.

What is claimed is:

1. A liquid ejection inspecting apparatus comprising:

(A) a sensing section arranged in a state of non-contact with a liquid ejection nozzle for ejecting a liquid;

(B) a detection circuit for detecting an induced current generated in the sensing section due to the liquid ejected from the liquid ejection nozzle and charged electrically;

(C) a determination section for determining whether or not the liquid is ejected from the liquid ejection nozzle normally, based on the induced current detected by the detection circuit; and (D) a substrate provided with the sensing section and a circuit component that constitutes the detection circuit, the sensing section being provided on one surface of the substrate, the circuit component that constitutes the detection circuit being provided on an other surface of the substrate.

2. A liquid ejection inspecting apparatus according to claim 1, wherein a ground section is provided on said other surface at a position corresponding to a position where the sensing section is provided.

3. A liquid ejection inspecting apparatus according to claim 1, wherein the sensing section is made of a plate-like member.

4. A liquid ejection inspecting apparatus according to claim 1, wherein the sensing section is formed as a pattern on the substrate.

5. A liquid ejection inspecting apparatus according to claim 1, wherein the liquid ejection inspecting apparatus includes a plurality of the liquid ejection nozzles, and wherein the sensing section is arranged in a direction in which the plurality of liquid ejection nozzles are arranged.

6. A liquid ejection inspecting apparatus according to claim 1, wherein the liquid ejection inspecting apparatus includes a plurality of the liquid ejection nozzles, the liquid ejection nozzles being capable of relative movement with respect to the sensing section, and wherein the sensing section is arranged in a direction intersecting with a direction in which the plurality of liquid ejection nozzles are arranged.

7. A liquid ejection inspecting apparatus according to claim 1, wherein a voltage is applied to the sensing section so that the liquid ejected from the liquid ejection nozzle is charged electrically.

8. A liquid ejection inspecting apparatus according to claim 7, wherein a circuit component that constitutes a circuit for applying the voltage to the sensing section is provided on said other surface of the substrate.

9. A liquid ejection inspecting apparatus according to claim 1, wherein the liquid ejection inspecting apparatus further comprises an electrode section to which a voltage is applied so that the liquid ejected from the liquid ejection nozzle is charged electrically.

10. A liquid ejection inspecting apparatus according to claim 9, wherein a circuit component that constitutes a circuit for applying the voltage to the electrode section is provided on said other surface of the substrate.

11. A liquid ejection inspecting apparatus comprising:

(A) a sensing section arranged in a state of non-contact with a liquid ejection nozzle for ejecting a liquid;

(B) a detection circuit for detecting an induced current generated in the sensing section due to the liquid ejected from the liquid ejection nozzle and charged electrically;

(C) a determination section for determining whether or not the liquid is ejected from the liquid ejection nozzle normally, based on the induced current detected by the detection circuit; and (D) a substrate provided with the sensing section and a circuit component that constitutes the detection circuit, the sensing section being provided on one surface of the substrate, the circuit component that constitutes the detection circuit being provided on an other surface of the substrate, (E) wherein a ground section is provided on the other surface at a position corresponding to a position where the sensing section is provided, (F) wherein the sensing section is formed as a pattern on the substrate, (G) wherein a voltage is applied to the sensing section so that the liquid ejected from the liquid ejection nozzle is charged electrically, (H) wherein a circuit for applying the voltage to the sensing section is provided on the other surface of the substrate, (I) wherein the liquid ejection inspecting apparatus includes a plurality of the liquid ejection nozzles, and (J) wherein the sensing section is arranged in a direction in which the plurality of liquid ejection nozzles are arranged.

12. A printing apparatus comprising:

(A) a nozzle for ejecting an ink;

(B) a sensing section arranged in a state of non-contact with the nozzle;

(C) a detection circuit for detecting an induced current generated in the sensing section due to the ink ejected from the nozzle and charged electrically;

(D) a determination section for determining whether or not the ink is ejected from the nozzle normally, based on the induced current detected by the detection circuit; and (E) a substrate provided with the sensing section and a circuit component that constitutes the detection circuit, the sensing section being provided on one surface of the substrate, the circuit component that constitutes the detection circuit being provided on an other surface of the substrate.

13. A liquid ejection system comprising:

a computer; and a liquid ejection apparatus that is connectable to the computer and that includes:

a liquid ejection nozzle for ejecting a liquid;

a sensing section arranged in a state of non-contact with the liquid ejection nozzle;

a detection circuit for detecting an induced current generated in the sensing section due to the liquid ejected from the liquid ejection nozzle and charged electrically;

a determination section for determining whether or not the liquid is ejected from the liquid ejection nozzle normally, based on the induced current detected by the detection circuit; and a substrate provided with the sensing section and a circuit component that constitutes the detection circuit, the sensing section being provided on one surface of the substrate, the circuit component that constitutes the detection circuit being provided on an other surface of the substrate.

* * * * *